US006242393B1

(12) United States Patent
Ishida et al.

(10) Patent No.: US 6,242,393 B1
(45) Date of Patent: Jun. 5, 2001

(54) TRACTION DRIVE FLUID

(75) Inventors: Noboru Ishida; Junya Kohno; Shinichi Shirahama; Tetsuo Okawa, all of Kanagawa-ken (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/288,264

(22) Filed: Apr. 8, 1999

(30) Foreign Application Priority Data

| | | |
|---|---|---|
| Apr. 8, 1998 | (JP) | 10-096504 |
| Apr. 8, 1998 | (JP) | 10-096505 |
| Apr. 8, 1998 | (JP) | 10-112711 |
| Apr. 8, 1998 | (JP) | 10-112712 |
| Apr. 8, 1998 | (JP) | 10-112713 |

(51) Int. Cl.[7] ..... C10M 105/02; C10M 105/04

(52) U.S. Cl. ..... 508/462; 508/484; 508/496; 508/499; 252/73; 585/20; 585/21; 585/560

(58) Field of Search ..... 508/462, 484, 508/496, 499; 585/20, 21, 560; 252/73

(56) References Cited

U.S. PATENT DOCUMENTS

| | | | | |
|---|---|---|---|---|
| 2,758,975 | * | 8/1956 | Cottle et al. | 508/462 |
| 2,871,191 | * | 1/1959 | Schott | 508/462 |
| 3,409,553 | * | 11/1968 | Scoggins | 508/484 |
| 4,464,277 | * | 8/1984 | Cousineau | 508/484 |
| 4,525,290 | * | 6/1985 | Tsubouchi et al. | 252/73 |
| 4,556,503 | * | 12/1985 | Tsubouchi et al. | 585/20 |
| 4,609,481 | * | 9/1986 | Tsubouchi et al. | 252/73 |
| 4,704,490 | * | 11/1987 | Tsubouchi et al. | 585/20 |
| 4,784,843 | * | 11/1988 | Segnitz et al. | 585/20 |
| 4,840,745 | * | 6/1989 | Tsubouchi et al. | 585/20 |
| 4,886,613 | * | 12/1989 | Yoshimura et al. | 252/79 |
| 4,886,614 | * | 12/1989 | Yoshimura et al. | 508/484 |
| 4,889,649 | * | 12/1989 | Murai et al. | 252/73 |
| 4,889,650 | * | 12/1989 | Yoshimura et al. | 252/79 |
| 4,975,215 | * | 12/1990 | Abe et al. | 252/73 |
| 5,009,803 | * | 4/1991 | Brandolese | 508/462 |
| 5,039,440 | * | 8/1991 | Yoshimura et al. | 508/484 |
| 5,075,024 | * | 12/1991 | Yoshimura et al. | 508/484 |
| 5,085,792 | * | 2/1992 | Marihiko et al. | 508/484 |
| 5,107,041 | * | 4/1992 | Abe et al. | 585/20 |
| 5,259,978 | * | 11/1993 | Yoshimura et al. | 252/79 |
| 5,262,076 | * | 11/1993 | Ishida et al. . | |
| 5,656,578 | * | 8/1997 | Tanka et al. | 508/462 |

* cited by examiner

*Primary Examiner*—Margaret Medley
(74) *Attorney, Agent, or Firm*—Akin, Gump, Strauss, Hauer & Feld, L.L.P.

(57) ABSTRACT

A traction drive fluid comprises a tractant selected from the specific types of hydrocarbons, carboxylates and carbonate, optionally an effective amount of a base oil selected from a mineral oil and a synthetic oil and additives selected from a viscosity index improver, a ashless dispersant, a phosphorus-containing additive, a friction adjusting agent, a metallic detergent, an oxidation inhibitor, a polar additive, a corrosion inhibitor, a rubber swelling agent, a antifoamer and a colorant.

10 Claims, No Drawings

TRACTION DRIVE FLUID

BACKGROUND OF THE INVENTION

1. Field of the Invention

This invention relates to traction drive fluids, more particularly to a traction drive fluid used not only for a power transmission mechanism such as the automatic transmission of traction drive type for an automobile but also for the hydraulic control mechanism thereof as well as the friction characteristics controlling mechanism for the wet clutch.

2. Prior Art

In the industrial machinery field, traction drive fluids have already been used for traction drive type power transmission devices which are designed to transmit power via a film of oil formed at the contacting surfaces of the operative parts. Such traction drive fluids used in these devices are required to have high traction coefficient, i. e. superior power transmission capabilities.

In recent years, extensive studies and investigations on a traction drive fluid have been made for its use of the continuously variable transmission of an automobile. When used for an automobile, the fluid is used not only for the power transmitting mechanism but also for the hydraulic controlling mechanism as well as the friction characteristics controlling mechanism for the wet clutch.

There has been known an automatic transmission fluid (ATF) which is a lubricant used for the hydraulic controlling mechanism and the friction characteristics controlling mechanism for the wet clutch constituting the transmission of an automobile. It is a well-known fact that ATF is required to be higher than a certain level in a kinematic viscosity at elevated temperatures and superior in flowability at low temperatures for performing the role of the hydraulic controlling mechanism. It is also well known that ATF is required to be blended with additives which are excelled in friction characteristics, particularly in shudder resistance characteristics for fulfilling the requirements in performing the role of the friction characteristics controlling mechanism, particularly the controlling mechanism having in addition slip controlling capabilities.

In the case where a traction drive fluid is used for the continuously variable transmission of traction drive type for an automobile, it is necessary for the fluid to have not only inherent superior power transmitting capabilities but also the capabilities required for ATF, that is, capabilities upon being used as a fluid for the hydraulic controlling mechanism and the friction controlling mechanism of the wet clutch.

Although there is a commercially available traction drive fluid sold under the tradename of "SANTOTRAC" which is widely known to have an excellent power transmitting capability, a traction drive fluid suitable for an automobile has not been place on the market because it needs to fulfill the requirements on the capabilities such as a flowability at low temperatures which are expected to exhibit upon being used for the continuously variable transmission of an automobile.

In view of the current situations, an object of the present invention is to provide a traction drive fluid which is excellent in not only power transmitting capabilities but also the capabilities required as a fluid for controlling hydraulic pressure and the friction characteristics of a wet clutch constituting the transmission of an automobile.

SUMMARY OF THE INVENTION

As a result of an extensive research conducted for solving the above-mentioned problems, the present inventors has developed a fluid for a traction drive, particularly a fluid for the continuously variable transmission of traction drive type for an automobile and more particularly such a fluid which can be utilized for a power transmitting mechanism and can be applicable for a hydraulic controlling mechanism as well as the friction characteristics controlling mechanism for the wet clutch.

According to the present invention, there is provided a traction drive fluid which comprises a tractant selected from the group consisting of naphthenic hydrocarbons (A) and (B), naphthenic carboxylates (C) and (D) and a naphthenic carbonate (E), said naphthenic hydrocarbon (A) being represented by the formula (1)

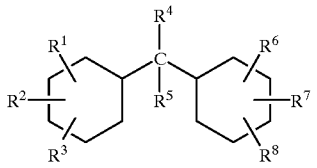

wherein among $R^1$ through $R^8$, $R^4$ is a $C_1$–$C_8$ alkyl group which may have a naphthene ring and the remainders each are a hydrogen atom or a $C_1$–$C_8$ alkyl group which may have a naphthene ring;

said naphthenic hydrocarbon (B) being represented by the formula (2)

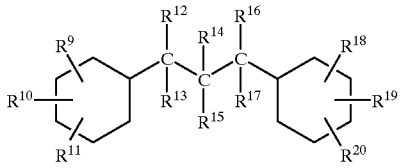

wherein among $R^9$ through $R^{20}$, at least more than two members selected arbitrary from $R^{12}$, $R^{13}$ and $R^{16}$ are $C_1$–$C_8$ alkyl groups which may have a naphthene ring and the remainders each are a hydrogen atom or a $C_1$–$C_8$ alkyl group which may have a naphthene ring;

said naphthenic carboxylate (C) being represented by the formula (3)

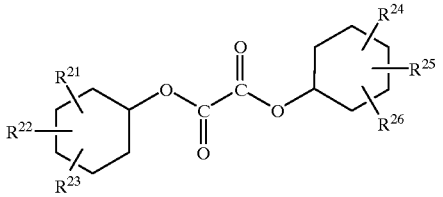

wherein $R^{21}$ through $R^{26}$ each are a hydrogen atom or a $C_1$–$C_8$ alkyl group which may have a naphthene ring;

said naphthenic carboxylate (D) being represented by the formula (4)

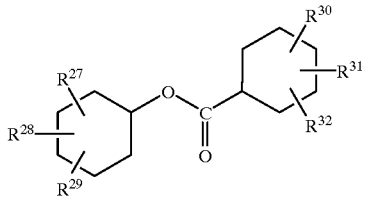

wherein $R^{27}$ through $R^{32}$ each are a hydrogen atom or a $C_1$–$C_8$ alkyl group which may have a naphthene ring; and said naphthenic carbonate (E) being represented by the formula (5)

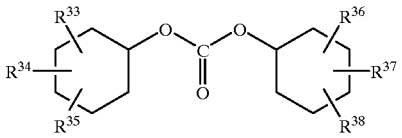

wherein $R^{33}$ through $R^{38}$ each are a hydrogen atom or a $C_1$–$C_8$ alkyl group which may have a naphthene ring.

The inventive traction drive fluid comprises the above-mentioned tractant and a base oil of at least one member selected from a mineral oil and a synthetic oil having a molecular weight of 150–800.

A viscosity index improver is preferably added to the above traction drive fluid. Preferred for such a viscosity index improver is a ethylene-α-olefin copolymer having a number-average molecular weight in excess of 800 and less than 150,000 and hydrides thereof.

Furthermore, the traction drive fluid is preferably blended with a ashless dispersant and a phosphorus-containing additive. More over, the traction drive fluid is preferably blended with a friction adjusting agent having at least one alkyl or alkenyl group of 6–30 carbon atoms in its molecule and having no hydrocarbon group of more than 31 carbon atoms. It is also preferred that the traction drive fluid is blended with a metal-containing detergent having a total base number of 20–450 mgKOH/g.

DETAILED DESCRIPTION OF THE INVENTION

The naphthenic hydrocarbon (A) of the tractant used for the inventive traction drive fluid is represented by the formula (1)

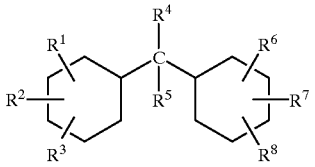

wherein among $R^1$ through $R^8$ $R^4$ is a $C_1$–$C_8$ alkyl group which may have a naphthene ring, preferably $C_1$–$C_4$ alkyl group, more preferably a methyl group and the remainders each are a hydrogen atom or a $C_1$–$C_8$ alkyl group which may have a naphthene ring, preferably a hydrogen atom or a $C_1$–$C_4$ alkyl group, more preferably a hydrogen atom or a methyl group.

Preferred naphthenic hydrocarbons of formula (1) in view of high traction coefficient are those represented by the formula (6)

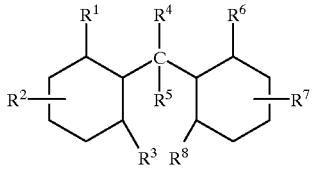

wherein $R^4$ is a $C_1$–$C_8$ alkyl group which may have a naphthene ring, preferably $C_1$–$C_4$ alkyl group, more preferably a methyl group, $R^1$ through $R^3$ and $R^5$ through $R^8$ each are a hydrogen atom or a $C_1$–$C_8$ alkyl group which may have a naphthene ring, preferably a hydrogen atom or a $C_1$–$C_4$ alkyl group, more preferably a hydrogen atom or a methyl group and at least one member, preferably at least more than two members, more preferably at least $R^1$ and $R^6$ selected arbitrary from $R^1$, $R^3$ and $R^6$ each are a $C_1$–$C_8$ alkyl group which may have a naphthene ring, preferably a $C_1$–$C_4$ alkyl group, more preferably a methyl group.

Furthermore, preferred naphthenic hydrocarbons of formula (1) in view of superior viscosity characteristics at low temperatures are those represented by the formula (11)

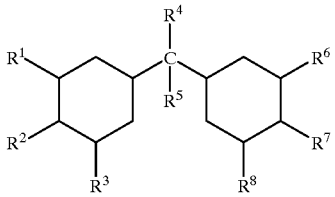

wherein $R^4$ is a $C_1$–$C_8$ alkyl group which may have a naphthene ring, preferably $C_1$–$C_4$ alkyl group, more preferably a methyl group, $R^1$ through $R^3$ and $R^5$ through $R^8$ each are a hydrogen atom or a $C_1$–$C_8$ alkyl group which may have a naphthene ring, preferably a hydrogen atom or a $C_1$–$C_4$ alkyl group, more preferably a hydrogen atom or a methyl group and at least one member selected from $R^1$ through $R^3$ and $R^5$ through $R^8$ is a $C_1$–$C_8$ alkyl group which may have a naphthene ring, preferably $C_1$–$C_4$ alkyl group, more preferably a methyl group.

Specific examples of the alkyl group for $R^1$ through $R^8$ are methyl, ethyl, n-propyl, isopropyl, n-butyl, isobutyl, sec-butyl, tert-butyl, straight or branched pentyl, straight or branched hexyl, straight or branched heptyl, straight or branched octyl, cyclopentylmethyl, cyclopentylethyl, cyclopentylpropyl, methylcyclopentylmethyl, ethylcyclopentylmethyl, dimethylcyclopentylmethyl, methylcyclopentylethyl, cyclohexylmethyl, cyclohexylethyl, methylcyclohexylmethyl and cycloheptylmethyl groups, among which particularly preferred are $C_1$–$C_4$ alkyl groups. The carbon number exceeding 9 would cause a deterioration in viscosity at low temperatures and is thus not preferred.

Specific examples of the naphthenic hydrocarbon (A) are the following compounds represented by formulae (12)

through (19). In the formulae given below, "A" represents a methylmethylene or dimethylmethylene group of the formulae
(12)
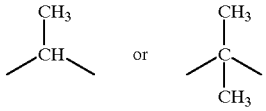
(1) The number of the alkyl group adding to the cyclohexane ring: 0
(13)
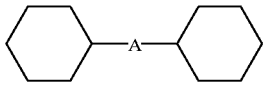
(1-1)
(2) The number of the alkyl group adding to the cyclohexane ring: 1
(14)
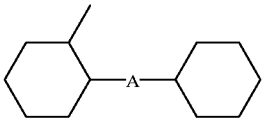
(2-1)
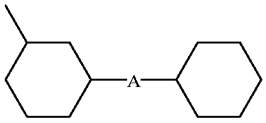
(2-2)
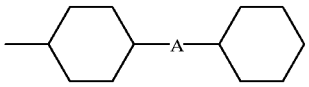
(2-3)
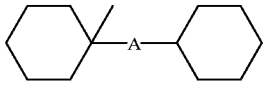
(2-4)
(3) The number of the alkyl group adding to the cyclohexane ring: 2
(15)
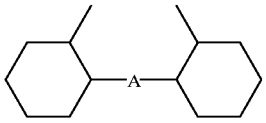
(3-1)
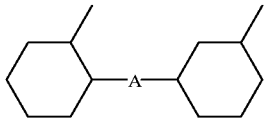
(3-2)
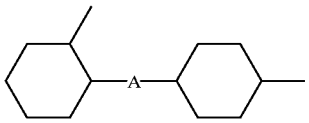
(3-3)
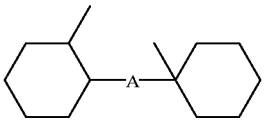
(3-4)
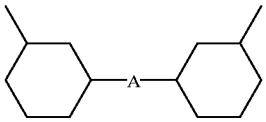
(3-5)
-continued
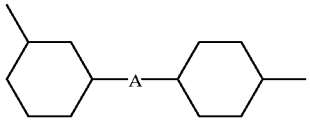
(3-6)
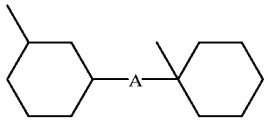
(3-7)
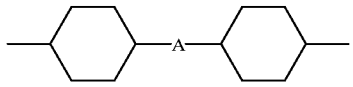
(3-8)
(16)
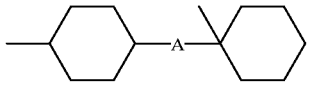
(3-9)
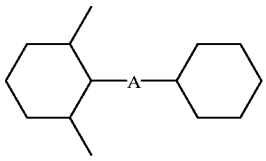
(3-10)
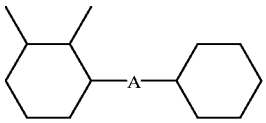
(3-11)
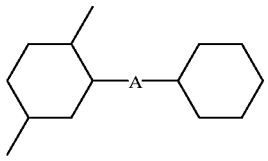
(3-12)
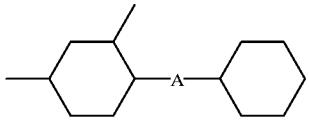
(3-13)
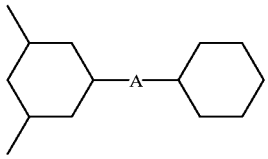
(3-14)
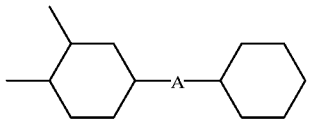
(3-15)

(4) The number of the alkyl group adding to the cyclohexane ring: 3
(17)
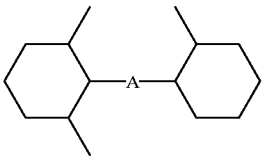
(4-1)
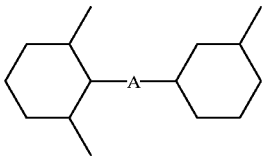
(4-2)
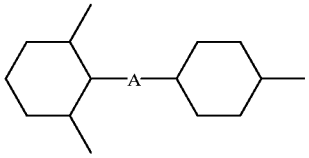
(4-3)
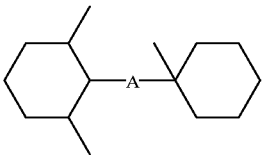
(4-4)
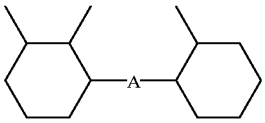
(4-5)
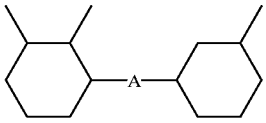
(4-6)
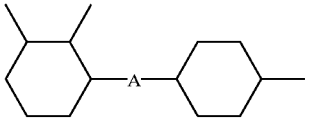
(4-7)
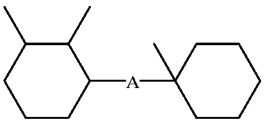
(4-8)
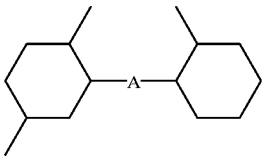
(4-9)
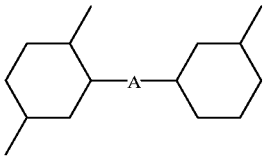
(4-10)
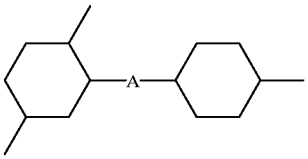
(4-11)
-continued
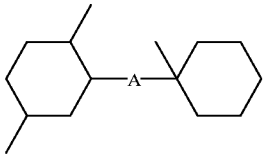
(4-12)
(18)
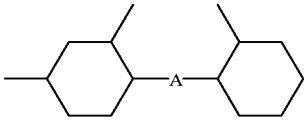
(4-13)
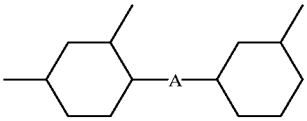
(4-14)
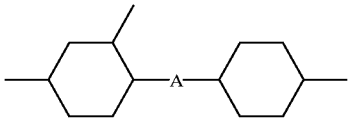
(4-15)
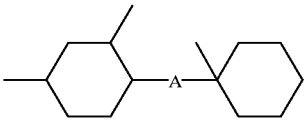
(4-16)
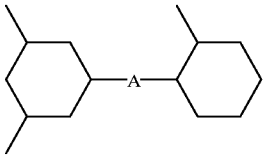
(4-17)
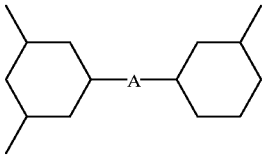
(4-18)
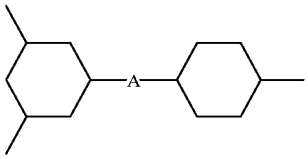
(4-19)
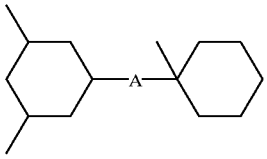
(4-20)
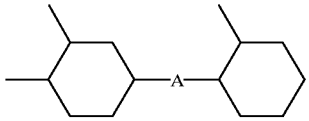
(4-21)

-continued
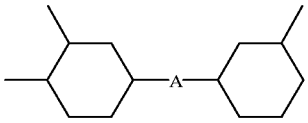
(4-22)
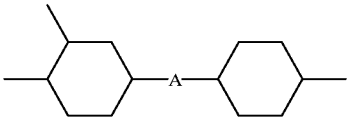
(4-23)
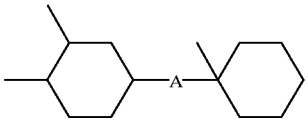
(4-24)
(5) The number of the alkyl group adding to the cyclohexane ring: 4
(19)
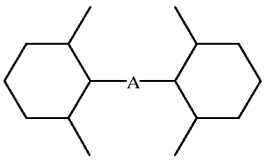
(5-1)
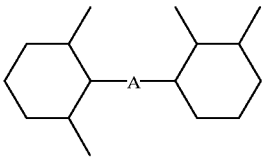
(5-2)
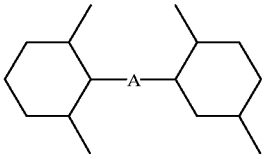
(5-3)
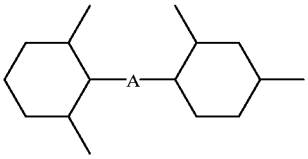
(5-4)
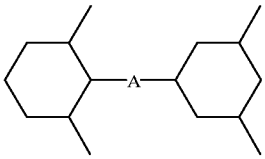
(5-5)
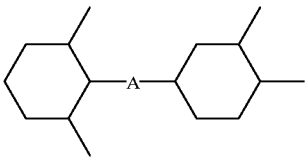
(5-6)
-continued
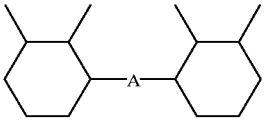
(5-7)
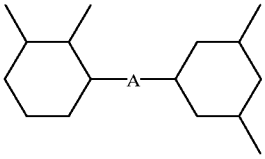
(5-8)
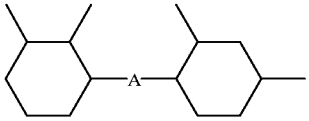
(5-9)
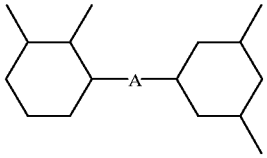
(5-10)
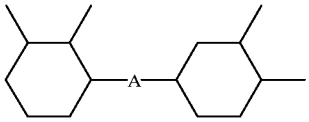
(5-11)
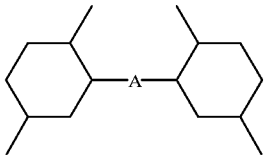
(5-12)
(20)
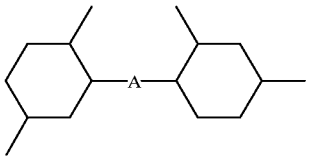
(5-13)
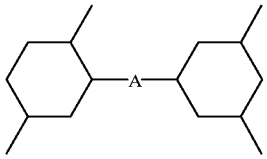
(5-14)
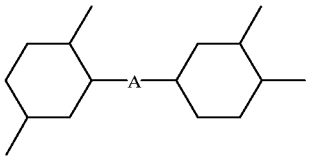
(5-15)
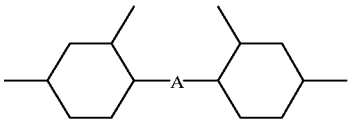
(5-16)

-continued

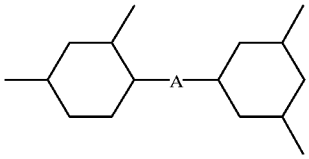

(5-17)

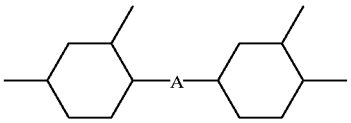

(5-18)

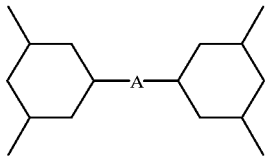

(5-19)

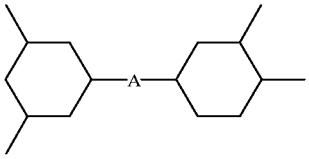

(5-20)

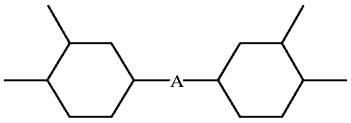

(5-21)

In view of increased traction coefficient, among these compounds, preferred are those represented by formulae of (2-1), (3-2), (3-3), (3-4), (3-11), (3-12), (3-13), (4-6), (4-7), (4-8), (4-10), (4-11), (4-12), (4-14), (4-15), (4-16), (4-17), (4-21), (5-10), (5-11), (5-14), (5-15), (5-17) and (5-18). More preferred are compounds of formulae of (3-10), (4-2), (4-3), (4-4), (5-5) and (5-6). Further more preferred are compounds of formulae of (3-1), (4-5), (4-9), (4-13), (5-7), (5-8), (5-9), (5-12), (5-13) and (5-16). Further more preferred are compounds of formulae of (4-1), (5-2), (5-3) and (5-4). Most preferred are compounds of formula (5-1).

The method for synthesizing the naphthenic hydrocarbon (A) of formula (1) is not restricted and thus various conventional methods may be applied such as the following synthetic method using addition reactions (1) Synthesis by Addition Reaction An aromatic compound of the formula (a)

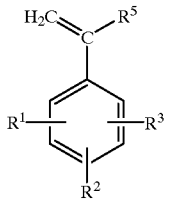

is reacted with an aromatic compound of the formula (b)

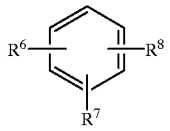

in the presence of an acidic catalyst such as sulfuric acid, methanesulfonic acid, white clay and a nonaqueous ion exchange resin (Amberite) at a temperature ranging from room temperature to 30° C. The product derived from this reaction is hydrogenated of the aromatic ring in the presence of a metallic hydrogenated catalyst such as nickel and platinum at a hydrogen pressure of 30–150 atm and at a temperature of 100–200° C. thereby obtaining the naphthenic hydrocarbon represented by the above formula (1).

The naphthenic hydrocarbon (B) of the tractant used for the inventive traction drive fluid is represented by the formula (2)

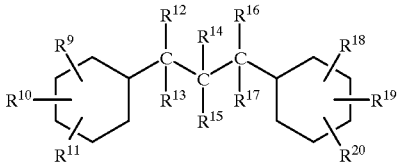

wherein among $R^9$ through $R^{20}$, at least more than two members selected arbitrary from $R^{12}$, $R^{13}$ and $R^{16}$ each are a $C_1$–$C_8$ alkyl group which may have a naphthenic ring, preferably a $C_1$–$C_4$ alkyl group, more preferably a methyl group, and the remainders each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group.

Preferred naphthenic hydrocarbon (B) of formula (2) are compounds represented by the formula (7)

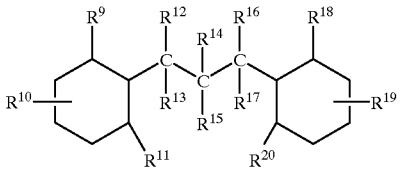

wherein $R^9$ through $R^{20}$ each are a hydrogen atom or a $C_1$–$C_8$ alkyl group which may have a naphthenic ring, preferably a hydrogen atom or a $C_1$–$C_4$ alkyl group, more preferably a hydrogen atom or methyl group and at least more than two members arbitrary selected from $R^{12}$, $R^{13}$ and $R^{16}$ each are a $C_1$–$C_8$ alkyl group which may have a naphthenic ring, preferably a $C_1$–$C_4$ alkyl group, more preferably a methyl group and at least one, preferably two members arbitrary selected from $R^9$, $R^{11}$, $R^{18}$ and $R^{20}$, more preferably at least $R^9$ and $R^{18}$ is a $C_1$–$C_8$ alkyl group which may have a naphthenic ring, preferably a $C_1$–$C_4$ alkyl group, more preferably a methyl group.

Specific examples of the alkyl group for $R^9$ through $R^{20}$ are the same as those exemplified with respect to $R^1$ through $R^8$ of the above formulae (1) and (2).

Specific examples of the naphthenic hydrocarbon of formula (2) are also represented by the above formulae (12) through (19). However, "A" in these formulae are represented by the formula (21)

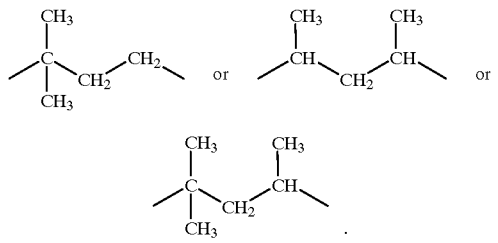

Among these compounds, preferred compounds are also the same as those represented by the formulae exemplified with respect to the description of the preferred compounds for the naphthenic hydrocarbon (A). Therefore, most preferred are compounds represented by formula (5-1).

There is no particular limitation imposed on the method for synthesizing the naphthenic hydrocarbon of formula (2) and thus there may be employed various conventional methods, such as the following methods.

(1) Synthesis by Addition Reaction

An aromatic compound of the formula (c)

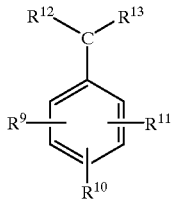

is reacted with an aromatic compound of the formula (d)

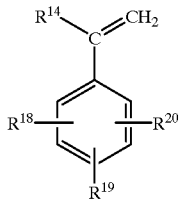

in the presence of an alkali catalyst such as metallic sodium, sodium hydroxide and potassium hydroxide at a temperature of 100–150° C. The product derived from this reaction is hydrogenated of the aromatic ring in the presence of a metallic hydrogenated catalyst such as nickel and platinum at a hydrogen pressure of 30–150 atm and at a temperature of 100–200° C. thereby obtaining the naphthenic hydrocarbon represented by the formula (22)

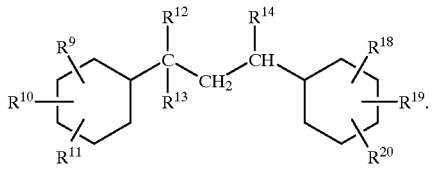

(2) Synthesis by Polymerization Reaction

An aromatic compound represented by the formula (e)

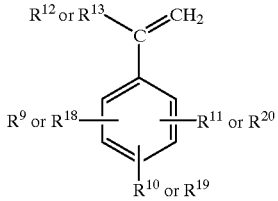

is dimerized by reacting in the presence of an acidic catalyst such as white clay and a nonaqueous ion exchange resin at a temperature ranging from room temperature to 70° C. The resulting dimer is hydrogenated of the aromatic ring in the presence of a metallic hydrogenated catalyst such as nickel and platinum at a hydrogen pressure of 30–150 atm and at a temperature of 100–200° C. thereby obtaining the naphthenic hydrocarbon represented by the formula (23)

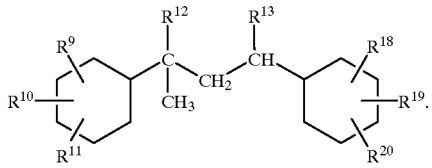

The naphthenic carboxylate (C) of the tractant used for the inventive traction drive fluid is represented by the formula (3)

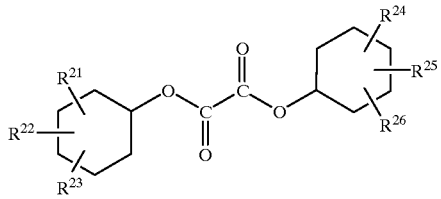

wherein $R^{21}$ through $R^{26}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group.

Preferred naphthenic carboxylate of formula (3) are compounds represented by the formula (8)

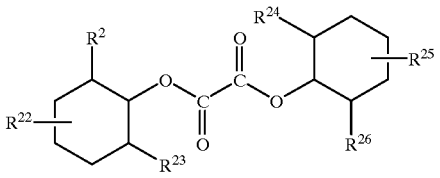

wherein $R^{21}$ through $R^{26}$ each are a hydrogen atom or a $C_1$–$C_8$ alkyl group which may have a naphthenic, preferably a hydrogen atom or a $C_1$–$C_4$ alkyl group, more preferably a hydrogen atom or methyl group and at least one, preferably more than two members arbitrary selected from $R^{21}$, $R^{23}$, $R^{24}$ and $R^{26}$ more preferably $R^{21}$ and $R^{24}$ each are a $C_1$–$C_8$ alkyl group which may have a naphthenic ring, preferably $C_1$–$C_4$ alkyl group, more preferably a methyl group.

Specific examples of the alkyl groups for $R^{21}$ through $R^{26}$ are the same as those already exemplified with respect to $R^1$ through $R^8$ of the above formulas (1) and (2).

Specific examples of the naphthenic carboxylate of formula (3) are also represented by the above formulae (12) through (19). However, "A" in these formulae are represented by the formula (24)

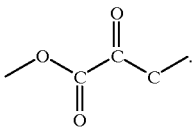

Among these compounds, preferred compounds are also represented by the same formulae as those exemplified with respect to the description of the preferred compounds for the naphthenic hydrocarbon (A). Therefore, most preferred are compounds represented by formula (5-1).

There is no particular limitation imposed on the method for synthesizing the naphthenic carboxylate of formula (3) and thus there may be employed various conventional methods such as the following methods.

(1) Synthesis by Esterification

An esterification reaction is conducted by using oxalic acid of the formula (f)

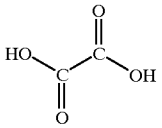

and alkylcyclohexanol of the formula (g)

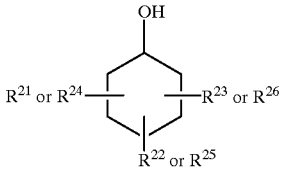

in the presence of a condensation catalyst such as phosphoric acid and sulfuric acid at a temperature of 100–200° C. thereby obtaining the naphthenic carboxylate of formula (3).

Alternatively, the naphthenic carboxylate of formula (3) is also produced by reacting alkylcyclohexanol or alkylphenol with alkylcyclohexanechloride or alkylbenzoic acid chloride in the presence of triethylamine at a temperature of 0–10° C. In this case, the resulting product contains aromatics, they must be saturated by hydrogenation.

(2) Synthesis by Ester Interchange Reaction

An ester interchange reaction is conducted by using a dialkyl oxalate of the formula (h)

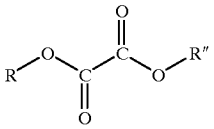

and alkylcyclohexanol of the above formula (g) in the presence of an alkali catalyst such as metallic sodium, sodium hydroxide and potassium hydroxide at a temperature of 100–200° C. thereby obtaining the naphthenic carboxylate of formula (3).

The naphthenic carboxylate (D) of the tractant used for the inventive traction drive fluid is represented by the formula (4)

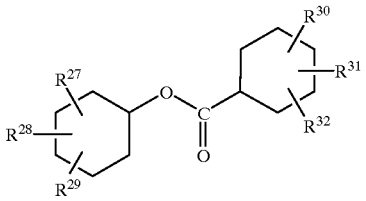

wherein $R^{27}$ through $R^{32}$ each are a hydrogen atom or a $C_1$–$C_8$ alkyl group which may have a naphthenic ring, preferably a hydrogen atom or a $C_1C_4$ alkyl group, more preferably a hydrogen atom or a methyl group.

Preferred naphthenic carboxylate of formula (4) are compounds represented by the formula (9)

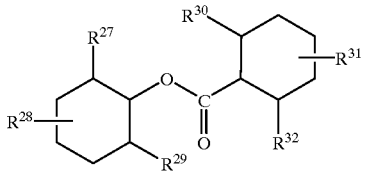

wherein $R^{27}$ through $R^{32}$ each are a hydrogen atom or a $C_1$–$C_0$ alkyl group which may have a naphthenic ring, preferably a hydrogen atom or a $C_1$–$C_4$ alkyl group, more preferably a hydrogen atom or methyl group and at least one, preferably more than two members arbitrary selected from $R^{27}$, $R^{29}$, $R^{30}$ and $R^{32}$, more preferably $R^{27}$ and $R^{30}$ is a $C_1$–$C_8$ alkyl group which may have a naphthenic ring, a $C_1$–$C_4$ alkyl group, more preferably a methyl group.

Specific examples of the alkyl groups for $R^{27}$ through $R^{32}$ are the same as those exemplified with respect to $R^1$ through $R^8$ of formulae (1) and (2).

Specific examples of the naphthenic carboxylate of formula (4) are also represented by the above formulae (12) through (19). However, "A" in these formulae are represented by the formula (25)

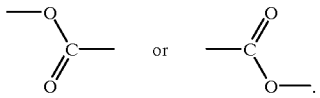

Among these compounds, preferred compounds are also represented by the same formulae as those exemplified with respect to the description of the preferred compounds for the naphthenic hydrocarbon (A). Therefore, most preferred are compounds represented by formula (5-1).

There is no particular limitation imposed on the method for synthesizing the naphthenic carboxylate of formula (4) and thus there may be employed various conventional methods such as the following methods.

(1) Synthesis by Esterification

An esterification reaction is conducted by using alkylcyclohexane carboxylic acid of the formula (i)

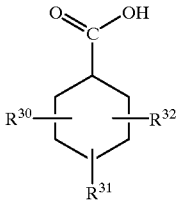

and alkylcyclohexanol of the formula (j)

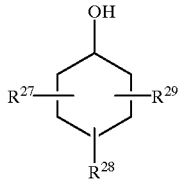

in the presence of a condensation catalyst such as phosphoric acid and sulfuric acid at a temperature of 100–200° C. thereby obtaining the naphthenic carboxylate of formula (4).

Alternatively, the naphthenic carboxylate of formula (4) is also produced by reacting alkylcyclohexanol or alkylphenol with alkylcyclohexanechloride or alkylbenzoic acid chloride in the presence of triethylamine at a temperature of 0–10° C. In this case, the resulting product contains aromatics, they must be saturated by hydrogenation.

(2) Synthesis by Ester Interchange Reaction

An ester interchange reaction is conducted by using an alkylcyclohexane carboxylate of the formula (k)

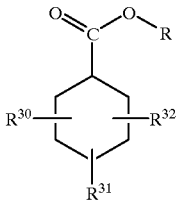

and alkylcyclohexanol of the above formula (i) in the presence of an alkali catalyst such as metallic sodium, sodium hydroxide and potassium hydroxide at a temperature of 100–200° C. thereby obtaining the naphthenic carboxylate of formula (4).

The naphthenic carbonate (E) of the tractant used for the inventive traction drive fluid is represented by the formula (5)

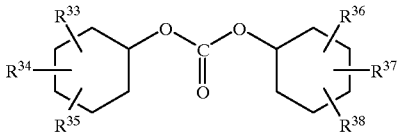

wherein $R^{33}$ through $R^{38}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group.

Preferred naphthenic carbonate of formula (5) are compounds represented by the formula (10)

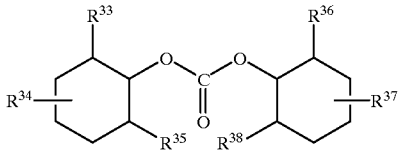

wherein $R^{33}$ through $R^{38}$ each are a hydrogen atom or a $C_1$–$C_8$ alkyl group which may have a naphthenic ring, preferably a hydrogen atom or a $C_1$–$C_4$ alkyl group, more preferably a hydrogen atom or methyl group and at least one, preferably more than to members arbitrary selected from $R^{33}$, $R^{35}$, $R^{36}$ and $R^{38}$, more preferably at least $R^{33}$ and $R^{36}$ each are a $C_1$–$C_8$ alkyl group which may have a naphthenic ring, preferably a $C_1$–$C_4$ alkyl group, more preferably a methyl group.

Specific examples of the alkyl group for $R^{33}$ through $R^{38}$ are the same as those already exemplified with respect to $R^1$ through $R^8$ of formulae (1) and (2).

Specific examples of the naphthenic carbonate of formula (5) are also represented by the above formulae (12) through (19). However, "A" in these formulae indicates an ester bond represented by the formula (26)

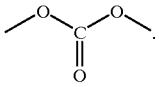

Among these compounds, preferred compounds are also represented by the same formulae as those exemplified with respect to the description of the preferred compounds for the naphthenic hydrocarbon (A). Therefore, most preferred are compounds represented by formula (5-1).

There Is no particular limitation imposed on the method for synthesizing the naphthenic carbonate of formula (5) and thus there may be employed various conventional methods such as the following methods.

Synthesis by Esterification Interchange Reaction

An ester interchange reaction is conducted by using diethylcarbonate of the formula (I)

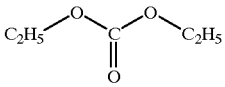

and alkylcyclohexanol of the formula (m)

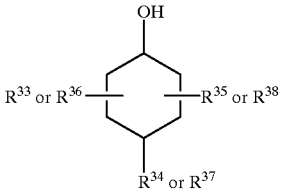

in the presence of an alkali catalyst such as metallic sodium, sodium hydroxide and potassium hydroxide at a temperature of 100–200° C. thereby obtaining the naphthenic carbonate of formula (5).

A traction drive fluid of the present invention preferably comprises a tractant selected from the group consisting of the above-described naphthenic hydrocarbons (A) and (B), naphthenic carboxylates (C) and (D) and a naphthenic carbonate (E) and a base oil selected from the group consisting of a mineral oil and a synthetic oil having a molecular weight of 150–800, preferably 150–800.

Specific examples of eligible mineral oil for the purpose of the invention are n-paraffins such as paraffinic- and naphthenic- mineral oils which are produced by subjecting lubricant fractions derived from atmospheric- or vacuum distillation of crude oil to refining processes such as solvent deasphalting, solvent extraction, hydrocracking, solvent dewaxing, catalytic dewaxing, hydrotreating, sulfuric acid washing, clay treatment and combinations thereof. Although the mineral oil is not restricted in kinematic viscosity, it is preferred use those having a kinematic viscosity at 100° C. within the range of usually 1–10 $mm^2/s$, preferably 2–8 $mm^2/s$.

In the present invention, it is necessary for a synthetic base oil to have a molecular weight of 150–500, preferably 150–500. Less than 150 in molecular weight would lead to an increase in evaporation loss, while greater than 800 would result in a deterioration in flowability at low temperatures of a traction drive.

Eligible synthetic oils may be poly-α-olefins such as 1-octene oligomer, 1-decene olygomer and ethylene-propylene oligomer and hydrides thereof, isobutene oligomer and hydroxide thereof, isoparaffin, alkylbenzene, alkylnaphthalene, diesters such as ditridecyl glutarate, di2-ethyl adipate, diisodecyl adipate, ditridecyl adipate and di2-ethylhexyl sebacate, polyol esters such as trimethylolpropane caprylate, trimethylolpropane pelargonate, pentaerythritol-2-ethyl hexanoate and pentaerythritol pelargonate, polyoxyalkylene glycol, dialkyldiphenyl ether and polyphenylether.

Because they are contributive to the production of a traction drive fluid which is excelled in total performances resulting from their characteristics such as high traction coefficient, excellent flowability at low temperatures and high viscosity at elevated temperatures, particularly preferred synthetic oils are isobutene oligomers or hydrides thereof and synthetic oils represented by the following formulae (27)

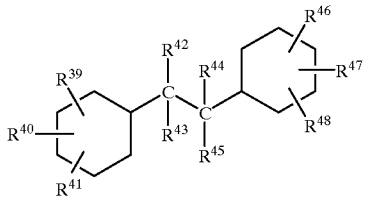

wherein $R^{39}$ through $R^{48}$ each are a hydrogen atom or a $C_1$–$C_8$ alkyl group which may have a naphthenic ring, preferably a hydrogen atom or a $C_1C_4$ alkyl group, more preferably a hydrogen atom or a methyl group;

(28)

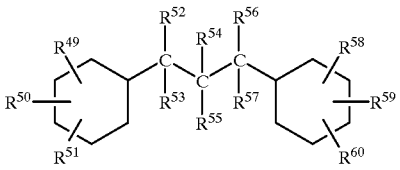

wherein $R^{49}$ through $R^{60}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group;

(29)

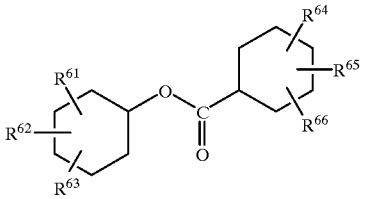

wherein $R^{61}$ through $R^{66}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group;

(30)

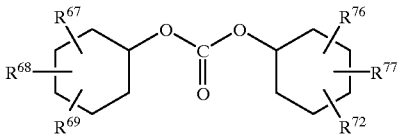

wherein $R^{67}$ through $R^{72}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group;

(31)

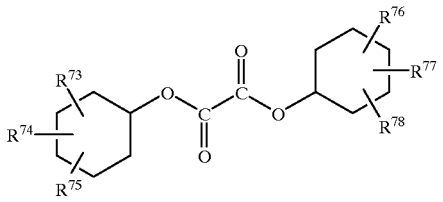

wherein $R^{73}$ and $R^{78}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group; and (32)

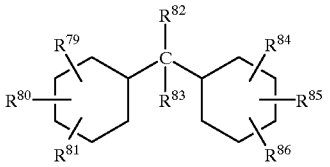

wherein $R^{79}$ and $R^{86}$ each are a hydrogen atom or a $C_1$–$C_8$ alkyl group which may have a naphthenic ring, preferably a hydrogen atom or a $C_1$–$C_4$ alkyl group, more preferably a hydrogen atom or a methyl group.

Specific examples of the alkyl groups for $R^{39}$ through $R^{86}$ in formulae (27) through (32) are methyl, ethyl, n-propyl, isopropyl, n-butyl, isobutyl, sec-butyl, tert-butyl, straight or branched pentyl, straight or branched heptyl, straight or branched octyl, cyclopentylmethyl, cyclopentylethyl, cyclopentylpropyl, methylcyclopentylmethyl, ethylcyclopentylmethyl, dimethylcyclopentylmethyl, methylcyclopentylethyl, cyclohexylmethyl, cyclohexylethyl, methylcyclohexylmethyl and cycloheptylmethyl groups. Among these groups, preferred are $C_1$–$C_4$ alkyl groups, more preferred are methyl groups.

Preferred combinations between the tractants and the synthetic base oils of formulae (27) through (32) are as follows:

(1) Naphthenic hydrocarbon (A) and the synthetic base oil of formula (27), (28), (29), (30) or (31);

(2) Naphthenic hydrocarbon (B) and the synthetic base oil of formula (27), (29), (30), (31) or (32);

(3) Naphthenic carboxylate (C) and the synthetic base oil of formula (27), (28), (29), (30) or (32);

(4) Naphthenic carboxylate (D) and the synthetic base oil of formula (27), (28), (30), (31) or (32); and (5) Naphthenic carbonate (E) and the synthetic base oil of formula (27), (28), (29), (31) or (32).

Although not restricted, the blend ratio of the tractant and the mineral oil and/or the synthetic oil is 1:99–100:0, preferably 5:95–100:0.

The inventive traction drive fluid is preferably blended with a viscosity index improver.

Eligible viscosity index improvers (Component V) are non-dispersion-type viscosity index improvers such as copolymers of one or more than two monomers selected from the group consisting of Compounds (V-1) of formulae (33)

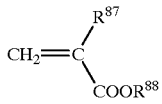

(34)

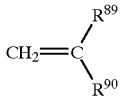

(35)

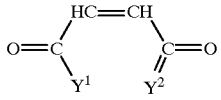

and or hydrides of the copolymers;

and dispersion-type viscosity index improvers such as copolymers of one or more of the monomers selected from Compounds (V-1) and one or more of monomers selected from Compounds (V-2) of formulae (36)

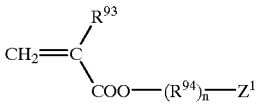

(37)

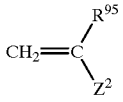

and or the hydrides of the copolymers.

In formula (32), $R^{87}$ is a hydrogen atom or methyl group and $R^{88}$ is a $C_1$–$C_{18}$ alkyl group.

In formula (33), $R^{89}$ is a hydrogen atom or a methyl group and $R^{90}$ is a $C_1$–$C_{12}$ hydrocarbon group.

In formula (34), $Y^1$ and $Y^2$ each are a hydrogen atom, an $C_1$–$C_{18}$ alkyl alcohol residue (—$OR^{91}$ wherein $R^{91}$ is a $C_1$–$C_{18}$ alkyl group) or a $C_1$–$C_{18}$ alkylmonoalkylamine residue (—$NHR^{92}$ wherein $R^{92}$ is a $C_1$–$C_{18}$ alkyl group).

Preferred alkyl groups having 1–18 carbon atoms for $R^{88}$ are methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl groups.

Preferred hydrocarbon groups for $R^{89}$ are an alkyl group such as methyl, ethyl, n-butyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl and straight or branched dodecyl groups; an alkenyl group such as straight or branched butenyl, straight or branched pentenyl, straight or branched hexenyl, straight or branched heptenyl, straight or branched octenyl, straight or branched nonenyl, straight or branched decenyl, straight or branched undecenyl and straight or branched dodecenyl groups; a $C_5$–$C_7$ cycloalkyl group such as cyclopentyl, cyclohexyl, cyclobutyl groups; a $C_6$–$C_{11}$ alkylcycloalkyl group such as methylcyclopentyl, dimethylcyclopentyl (including all structural isomers), methylethylcyclopentyl (including all structural isomers), diethylcyclopentyl (including all structural isomers), methylcyclohexyl, dimethylcyclohexyl(including all structural isomers), methylethylcyclohexyl (including all structural isomers), diethylcyclohexyl (including all structural isomers), methylcycloheptyl, dimethylcycloheptyl (including all structural isomers), methylethylcycloheptyl (including all structural isomers) and diethylcycloheptyl (including all structural isomers) groups; an aryl group such as phenyl and naphtyl groups; a $C_7$–$C_{12}$ alkylaryl group such as tolyl (including all structural isomers), xylyl (including all structural isomers), ethylphenyl (including all structural isomers), straight or branched propylphenyl (including all structural isomers), straight or branched pentylphenol (including all structural isomers) and straight or branched hexylphenyl (including all structural isomers) groups; a $C_7$–$C_{12}$ arylalkyl group such as benzyl, phenylethyl, phenylpropyl (including an isomer of propyl group), phenylbutyl (including an isomer of butyl group), phenylpentyl (including an isomer of pentyl group), phenylhexyl (including an isomer of hexyl) groups.

Preferred monomers for Component (V-1) are a $C_1$–$C_{18}$ alkylacrylate, a $C_1$–$C_{18}$ alkylmethacrylate, a $C_2$–$C_{20}$ olefin , styrene, methylstyrene, maleic anhydride ester, maleic anhydride amide and mixtures thereof.

In formula (35), $R^{93}$ is a hydrogen atom or methyl group, $R^{94}$ is a $C_2$–$C_{18}$ alkylene group, $Z^1$ is an amine residue having one or two nitrogen atom and 0–2 oxygen atoms or a heterocyclic residue and a is an integer of 0 or 1.

In formula (36), $R^{95}$ is a hydrogen atom or methyl group, $Z^2$ is an amine residue having one or two nitrogen atom and 0–2 oxygen atoms or a heterocyclic residue.

Specific examples of the alkyl groups for $R^{94}$ are straight or branched ethylene, straight or branched propylene, straight or branched butylene, straight or branched pentylene, straight or branched hexylene, straight or branched heptylene, straight or branched octylene, straight or branched nonilene, straight or branched decylene, straight or branched undecylene, straight or branched dodecylene, straight or branched tridecylene, straight or branched tetradecylene, straight or branched pentadecylene, straight or branched hexadecylene, straight or branched heptadecylene and straight or branched octadecylene groups. Preferred examples of the groups for each $Z^1$ and $Z^2$ are dimethylamino, diethylamino, dipropylamino, dibutylamino, anilino, toluidino, xylidino, acetylamino, benzoilamino, morpholino, pyrolyl, pyrolino, pyridyl, methylpyridyl, pyrrolidinyl, piperidinyl, quinonyl, pyrrolidonyl, pyrrolidono, imidazolino and pyrazino groups.

Nitrogen-containing monomers preferred for Component (V-2) are dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone and mixtures thereof.

The term "dispersion type viscosity index improver" used herein designates copolymers obtained by altering the nitrogen-containing monomer like Component (V-2) to a comonomer. The dispersion type viscosity index improver may be produced by copolymerizing one or more of the monomers selected from Components (V-1) with one or more of the nitrogen-containing monomer selected from Components (V-2). The molar ratio of Component (V1) to Component (V-2) upon copolymerization is optional but is generally within the range of 80:20–95:5. The polymerization method is also optional but may be preferably conducted by radical-solution polymerization of Components (V-1) and (V-2) in the presence of a polymerization initiator such as benzoyl peroxide.

Specific examples of the viscosity index improver are non-dispersion type- and dispersion type polymethacrylates, non-dispersion type- and dispersion type- ethylene-α-olefin coplymers and hydrides thereof, polyisobutylenes and hydrides thereof, styrene-diene hydrogenated copolymers, styrene-maleic anhydride ester copolymers and polyalkylstyrene.

It is made possible by blending one or more member selected from these viscosity index improvers to enhance viscosity at elevated temperatures particularly needed by a traction drive fluid for an automobile and improve the balance between the viscosity and flowability at low temperatures.

Although not restricted, the viscosity index improver may be added to the inventive traction drive fluid in an amount of 0.1–20 mass percent, preferably 0.1–10 mass percent. The amount in excess of 20 mass percent would reduce the traction coefficient, while the amount less than 0.1 mass percent would result in poor effect.

The viscosity index improver is used together with the solvent for the synthesis thereof. In the present invention, such a solvent is preferably selected from the compounds of the above formulae (1) through (5), isobutene oligomers and hydrides thereof and the compounds of the above formulae (26) through (31). Needless to mention, when using the solvent selected from the compounds of the above formulae (1) through (5), it is preferred to select the same one as the tractant to be used. Similarly, when using the solvent selected from the compounds of the above formulae (27) through (32), it is preferred to use one of the compounds preferred with respect to the tractant to be used.

It is necessary to select the molecular weight of the viscosity index improver in view of shear stability. Specifically, the dispersion type- and non-dispersion type-polymethacrylates may be 5,000–150,000, preferably 5,000–35,000 in number-average molecular weight, while polyisobutylenes and hydrides thereof should be 800–5,000, preferably 2,000–4,000. The polyisobutylene and hydrides thereof less than 800 in number-average molecular weight would reduce the thickening characteristics and traction coefficient of the resulting traction drive fluid, while those in excess of 5,000 would deteriorate the shear stability and flowability at low temperatures of the resulting traction drive fluid.

Among these viscosity index improvers, the ethylene-α-olefin copolymers having a number-average molecular weight of over 800 and less than 150,000, preferably 3,000–20,000 or hydrides thereof are particularly preferred because they are contributive to provide a traction drive fluid excelled in total performances such as enhanced traction coefficient and excelled flowability at low temperatures and viscosity at elevated temperatures. The ethylene-α-olefin copolymers and hydrides thereof if less than 800 in number-average molecular weight would result in a traction drive fluid reduced in thickening characteristics and traction coefficient the resulting traction drive fluid and if greater than 150,000 would deteriorate the shear stability thereof.

Although not restricted, the ethylene component may be contained in the ethylene-α-olefin copolymers or hydrides thereof in an amount of preferably 30–80 mol percent, more preferably 50–80 mol percent. Eligible α-olefins are propylene and 1-butene, the former is more preferred.

The traction drive fluid preferably further contains an ashless dispersant and a phosphorus-containing additive. Due to the addition of such an ashless dispersant (hereinafter referred to as Component U) and a phosphorus-containing additive (hereinafter referred to as Component P), it becomes possible to provide the inventive traction drive fluid with performances such as abrasive resistance characteristics, oxidation stability and detergency which are required for a hydraulic pressure controlling mechanism.

Component (Q) may be a nitrogen-containing compound, derivatives thereof or a modified product of alkenyl succinate imide each having at least one alkyl or alkenyl group having 40–400 carbon atoms in the molecules. One or more of these compounds may be added to the inventive traction drive fluid.

The alkyl and alkenyl groups may be straight or branched and specifically are branched alkyl and alkenyl groups derived from oligomers of olefins such as propylene, 1-butene and isobutylene or cooligomers of ethylene and propylene.

The carbon number of the alkyl or alkenyl group is 40–400, preferably 60–350. The alkyl or alkenyl group if less than 40 in carbon number would result in the compound which is poor in solubility to the lubricant base oil and if exceeding 400 would deteriorate the flowability of the resulting traction drive fluid.

Although not restricted, the nitrogen-containing compound of Component (Q) may contain nitrogen in an amount of 0.01–10 mass percent, preferably 0.1–10 mass percent.

Specific examples of Component (Q) are (Q-1) succinate imide having in its molecules at least one alkyl or alkenyl group of 40–400 carbon atoms or derivatives thereof, (Q-2) benzyl amine having in its molecules at least one alkyl or alkenyl group of 40–400 carbon atoms or derivatives thereof and (Q-3) polyamine having in its molecules at least one alkyl or alkenyl group of 40–400 carbon atoms or derivatives thereof.

Specific examples of the succinate imide (Q-1) may be compounds represented by the formulae (38)

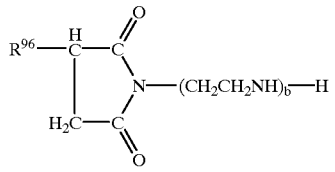

wherein $R^{96}$ is an alkyl or alkenyl group having 40–400, preferably 60–350 carbon atoms and b is an integer of 1–5, preferably 2–4;

(39)

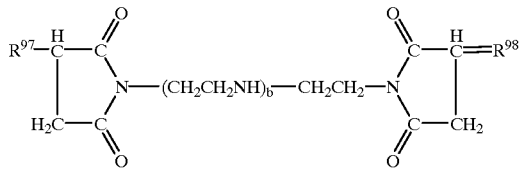

wherein $R^{97}$ and $R^{98}$ each are an alkyl or alkenyl group having 40–400, preferably 60–350 carbon atoms and c is an integer of 0–4, preferably 1–3.

The succinimide (Q-1) can be classified into mono type succinimide in which succinic anhydride is added to one end of polyamine as represented by formula (38) and bis-type succinimide in which succinic anhydrides are added to both ends of polyamine as represented by formula (39). Both type of succinimides or mixtures thereof are eligible as Component (Q-1).

Specific examples of benzyl amine (Q-2) are compounds represented by the formula (40)

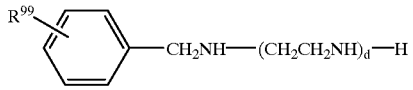

wherein $R^{99}$ is an alkyl or alkenyl group having 40–400, preferably 60–350 carbon atoms and d is an integer of 1–5, preferably 2–4.

There is no particular limitation imposed on the method of producing the benzyl amine. For example, the benzyl amine may be produced by reacting phenol with polyolefin such as propylene oligomer, polybutene and ethylene-α-copolymer to obtain alkylphenol and then subjecting it to Mannich reaction with formaldehyde and polyamine such as diethyltriamine, triethylenetetraamine, tetraethylenepentamine and pentaethylenehexamine.

Specific examples of the polyamine (Q-3) are compounds represented by the formula (41)

wherein $R^{100}$ is an alkyl or alkenyl group having 40–400, preferably 60–350 carbon atoms and e is an integer of 1–5, preferably 2–4.

Although not restricted, the polyamine may be produced by chloridizing propylene oligomer, polybutene and ethylene-α-copolymer to obtain alkylphenol, followed by the reaction thereof with ammonia and polyamine such as diethyltriamine, triethylenetetraamine, tetraethylenepentamine and pentaethylenehexamine.

The derivative of the nitrogen-containing compound as exemplified for Component (Q) may be an acid-modified compound obtained by allowing the above-described nitrogen-containing compound to react with monocarboxylic acid (aliphatic acid) having 2–30 carbon atoms or polycarboxylic acid having 2–30 carbon atoms such as oxalic acid, phthalic acid, trimellitic add and pyromellitic acid to neutralizing the whole or part of the remaining amino and/or imino groups; a boron-modified compound obtained by allowing the above-described nitrogen-containing compound to react with boric acid to neutralizing the whole or part of the remaining amino and/or imino groups; a sulfur-modified compound obtained by allowing the above-described nitrogen-containing compound to react with sulfur; and a compound obtained by combining more than two of the above modifications.

Although not restricted, Component (Q) may be contained in an amount of 0.01–10.0 weight percent, preferably 0.1–7.0 weight percent, based on the total composition. Contents of Component (Q) if less than 0.01 mass percent would be less effective in detergency and if in excess of 10.0 mass percent would extremely deteriorate the flowability of the resulting traction drive fluid.

Component (P) may be alkyldithio zinc phosphate, phosphoric acid, phosphorous acid, phosphoric monoesters, phosphoric diesters, phosphoric triesters, monophosphites, diphosphites, triphosphites, and salts of these esters and amines or alkanol amines. Components (P) are esters having a $C_3$–$C_{18}$ alkyl and/or alkenyl group and/or aromatics such as phenyl and toluylic groups except for the phosphoric acid and phosphorus acid.

These Components (P) may be used singular or in combination.

Although not restricted, Component (P) may be added in an amount of 0.005–0.2 weight percent in terms of phosphorus atom. Contents less than 0.005 weight percent would be no effect in abrasion resistance, while contents exceeding 0.2 would result in a deterioration in oxidation stability.

According to the invention, the traction drive fluid preferably further contains a friction-adjusting agent. The friction-adjusting agent is a compound having its molecules at least one alkyl or alkenyl group having 6–30 carbon atoms but no hydrocarbon groups of more than 31 carbon atoms. Due to the addition of the friction-adjusting agent (hereinafter referred to as Component S), it becomes possible to obtain a traction drive fluid optimized in friction characteristics.

The alkyl and alkenyl groups of the compound (Component (S)) may be straight or branched but preferred are compounds having these groups of 6–30, preferably 9–24 carbon atoms. Departures from the range of the specified carbon number would deteriorate the wet-type clutch in friction characteristics.

Specific examples of the alkyl and alkenyl groups are an alkyl group such as straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl and straight or branched triacontyl groups; and an alkenyl group such as straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched nonadecenyl, straight or branched eicosenyl, straight or branched heneicosenyl, straight or branched docosenyl, straight or branched tricosenyl, straight or branched tetracosenyl, straight or branched pentacosenyl, straight or branched hexacosenyl, straight or branched heptacosenyl, straight or branched octacosenyl, straight or branched nonacosenyl and straight or branched triacontenyl groups.

Friction-adjusting agents if having more than 31 carbon atoms would deteriorate the friction characteristics of a wet-type clutch.

Specific examples of the friction-adjusting agent (Component (S)) are preferably one or more compounds selected from:

(S-1) an amine compound having at least one alkyl or alkenyl group of 9–30 carbon atoms and having no hydrocarbon groups of more than 31 carbon atoms, or derivatives thereof;

(S-2) a phosphorus compound having at least one alkyl or alkenyl group of 9–30 carbon atoms and having no hydrocarbon groups of more than 31 carbon atoms, or derivatives thereof; and (S-3) the amide or metallic salt of a fatty acid having at least one alkyl or alkenyl group of 9–30 carbon atoms and having no hydrocarbon groups of more than 31 carbon atoms, or derivatives thereof.

Specific examples of the amine compound (S-1) are aliphatic monoamines of the formula (42)

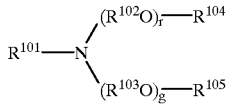

or alkyleneoxide adducts thereof; aliphatic polyamines of the formula;

(43)

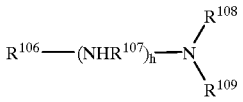

and imidazolyne compounds of the formula (44)

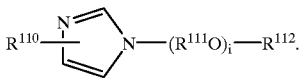

In formula (41), $R^{101}$ is a $C_9$–$C_{30}$, preferably $C_{11}$–$C_{24}$ alkyl or alkenyl group, $R^{102}$ and $R^{103}$ each are ethylene or propylene group, $R^{104}$ and $R^{105}$ each are a hydrogen atom or a $C_1$–$C_{30}$ hydrocarbon group, f and g each are an integer of 0–10, preferably 0–6 and f+g=0–10, preferably 0–6.

In formula (42), $R^{106}$ is a $C_9$–$C_{30}$, preferably $C_{11}$–$C_{24}$ alkyl or alkenyl group, $R^{107}$ is an ethylene or propylene group, $R^{108}$ and $R^{109}$ each are a hydrogen atom or a $C_1$–$C_{30}$ hydrocarbon group and h is an integer of 1–5, preferably 1–4.

In formula (43), $R^{110}$ is a $C_9$–$C_{30}$, preferably $C_{11}$–$C_{24}$ alkyl or alkenyl group, $R^{111}$ is ethylene or propylene group, $R^{112}$ is a hydrogen atom or a $C_1$–$C_{30}$ hydrocarbon group and i is an integer of 0–10, preferably 0–6.

The alkyl and alkenyl groups for $R^{101}$, $R^{106}$ and $R^{110}$ may be straight or branched but should have 6–30, preferably 9–24 carbon atoms. Departures from the specified range of carbon atoms would result in a traction drive fluid deteriorating the friction characteristics for a wet-type clutch.

Specific examples of the alkyl and alkenyl groups for $R^{101}$, $R^{106}$ and $R^{110}$ are the above-mentioned various alkyl and alkenyl groups among which particularly preferred are $C_{12}$–$C_{18}$ straight alkyl and alkenyl groups such as laulyl, myristyl, palmityl, stearyl and oleyl groups.

Specific examples for $R^{104}$, $R^{105}$, $R^{108}$, $R^{109}$ and $R^{112}$ are a hydrogen atom and an alkyl group, such as methyl, ethyl, isopropyl, n-butyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl and straight or branched triacontyl groups; an alkenyl group such as straight or branched butenyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched nonadecenyl, straight or branched eicosenyl, straight or branched heneicosenyl, straight or branched docosenyl, straight or branched tricosenyl, straight or branched tetracosenyl, straight or branched pentacosenyl, straight or branched hexacosenyl, straight or branched heptacosenyl, straight or branched octacosenyl, straight or branched nonacosenyl and straight or branched triacontenyl groups; a $C_5$–$C_7$ cycloalkyl group such as cyclopentyl, cyclohexyl and cycloheptyl groups; a $C_6$–$C_{11}$ alkylcycloalkyl group such as methylcyclopentyl, dimethylcyclopentyl (including all structural isomers), methylethylcyclopentyl (including all structural isomers), diethylcyclopentyl (including all structural isomers), methylcyclohexyl, dimethylcyclohexyl (including all structural isomers), methylethylcyclohexyl (including all structural isomers), diethylcyclohexyl (including all structural isomers), methylcycloheptyl, dimethylcycloheptyl (including all structural isomers), methylethylcycloheptyl (including all structural isomers) and diethylcycloheptyl (including all structural isomers) groups; an aryl group such as phenyl and naphtyl groups; a $C_7$–$C_{18}$ alkylaryl group such as tolyl (including all structural isomers), xylyl (including all structural isomers), ethylphenyl (including all structural isomers), straight or branched propylphenyl (including all structural isomers), straight or branched butylphenyl (including all structural isomers), straight or branched pentylphenyl (including all structural isomers), straight or branched hexylphenyl (including all structural isomers), straight or branched heptylphenyl (including all structural isomers), straight or branched octylphenyl (including all structural isomers), straight or branched nonylphenyl (including all structural isomers), straight or branched decylphenyl (including all structural isomers), straight or branched undecylphenyl (including all structural isomers) and straight or branched dodecylphenyl (including all structural isomers) groups; and a $C_7$–$C_{12}$ arylalkyl group such as benzyl, phenylethyl, phenylpropyl (including an isomer of propyl), phenylbutyl (including an isomer of butyl), phenylpentyl (including an isomer of pentyl) and phenylhexyl (including an isomer of hexyl) groups.

In view of imparting good friction characteristics to a wet-type clutch, preferred aliphatic monoamines represented by formula (41) or alkyleneoxide adduct thereof are those of formula (42) wherein $R^{104}$ and $R^{105}$ each are a hydrogen atom or a $C_1$–$C_6$ alkyl group and f=g=0 and alkyleneoxide adduct of monoamine of formula (42) wherein $R^{104}$ and $R^{105}$ each are a hydrogen atom and f and g each are an integer of 0–6 and f+g=1–6.

In view of imparting good friction characteristics to a wet-type clutch, preferred aliphatic polyamines of formula (43) are those represented by formula (43) wherein $R^{106}$ and $R^{109}$ each are a hydrogen atom or a $C_1$–$C_6$ alkyl group.

In view of imparting good friction characteristics to a wet-type clutch, preferred imidazoline compound of formula (44) are those represented by formula (43) wherein $R^{112}$ is a hydrogen atom or a $C_1$–$C_6$ alkyl group.

The derivatives of the amine compound (S-1) may be (1) an acid-modified compound obtained by allowing the above-described amine compound of formula (42), (43) or (44) to react with monocarboxylic acid (aliphatic acid) having 2–30 carbon atoms or polycarboxylic acid having 2–30 carbon atoms such as oxalic acid, phthalic acid, trimellitic acid and pyromellitic acid to neutralizing the whole or part of the remaining amino and/or imino groups; (2) a boron-modified compound obtained by allowing the amine compound of formula (42), (43) or (44) to react with boric acid to neutralizing the whole or part of the remaining amino and/or imino groups; (3) a salt of phosphate obtained by allowing the amine compound of formula (42), (43) or (44) to react with acid phosphate or acid phosphite each having in its molecules one or two $C_1$–$C_{30}$ hydrocarbon with no hydrocarbons of more than 31 carbon atoms and having at least one hydroxyl group to neutralize the whole or part of the remaining amino or imino group; (4) alkyleneoxide adducts of an amine compound obtained by allowing the amine compound of formula (43) or (44) to react with an alkyleneoxide such as ethylene oxide and propylene oxide; and (5) a modified product of amine compound obtained by combining more than two members selected from the acid-modified compound, the boron-modified compound and the salt of phosphate.

Specific examples of the amine compound (S-1) and derivatives thereof are amine compounds such as lauryl amine, lauryl diethylamine, lauryl diethanolamine, dodecyldipropanolamine, palmitylamine, stearylamine, stearyltetraethylenepentamine, oleylamine, oleylpropylenediamine, oleyldiethanolamine, N-hydroxyethyloleylimidazolyne: alkyleneoxide adducts thereof; salts of these amine compounds and acid phosphate (for example di-2-ethylhexylphosphate) or phosphite (for example 2-ethylhexylphosphite); a boric acid-modified product of these amine compounds, alkyleneoxide adducts of these amine compounds or phosphites of these amine compounds; and mixtures thereof.

Specific examples of the phosphorus compound (S-2) are phosphates represented by the formula (45)

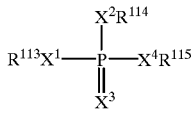

wherein $R^{113}$ is a $C_6$–$C_{30}$, preferably $C_9$–$C_{24}$ alkyl or alkenyl group, $R^{114}$ and $R^{115}$ each are a hydrogen atom or a $C_1$–$C_{30}$ hydrocarbon group and $X^1$, $X^2$, $X^3$ and $X^4$ each are an oxygen or sulfur atom provided that at least one of $X^1$ through $X^4$ is an oxygen atom; and phosphites represented by the formula (46)

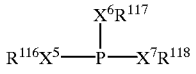

wherein $R^{116}$ is a $C_6$–$C_{30}$, preferably $C_9$–$C_{24}$ alkyl or alkenyl group, $R^{117}$ and $R^{118}$ each are a are a hydrogen atom or a $C_1$–$C_{30}$ hydrocarbon group and $X^5$, $X^6$ and $X^7$ each are an oxygen or sulfur atom provided that at least one of $X^5$ through $X^7$ is an oxygen atom.

The alkyl or alkenyl group for $R^{113}$ and $R^{116}$ may be straight or branched but should have 6–30, preferably 9–24 carbon atoms.

Departures form the above-specified range of carbon number would lead to the production of a traction drive fluid deteriorated in friction characteristics for a wet-type clutch.

Specific examples of the alkyl and alkenyl groups are the above-mentioned various alkyl and alkenyl groups among which particularly preferred are $C_{12}$–$C_{18}$ straight alkyl and alkenyl groups such as laulyl, myristyl, palmityl, stearyl and oleyl groups in view of imparting the resulting traction drive fluid with an excellent friction characteristics for a wet-type clutch.

Specific examples of the groups for $R^{114}$, $R^{115}$, $R^{117}$ and $R^{118}$ are a hydrogen atom, an alkyl group such as methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl, straight or branched tetracosyl, straight or branched pentacosyl, straight or branched hexacosyl, straight or branched heptacosyl, straight or branched octacosyl, straight or branched nonacosyl, and straight or branched triacontyl groups; an alkenyl group such as straight or branched butenyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched nonadecenyl, straight or branched eicocenyl, straight or branched heneicocenyl, straight or branched dococenyl, straight or branched tricocenyl, straight or branched tetracocenyl, straight or branched pentacocenyl, straight or branched hexacocenyl, straight or branched heptacocenyl, straight or branched octacocenyl, straight or branched nonacocenyl and straight or branched triacontenyl groups; a $C_5$–$C_7$ cycloalkyl group such as cyclopentyl, cyclohexyl and cycloheptyl groups; a $C_6$–$C_{11}$ alkylcycloalkyl group such as methylcyclopentyl, dimethylcyclopentyl (including all structural isomers), methylethylcyclopentyl (including all structural isomers), diethylcyclopentyl (including all structural isomers), methylcyclohexyl, dimethylcyclohexyl (including all structural isomers), methylethylcyclohexyl (including all structural isomers), diethylcyclohexyl (including all structural isomers), methylcycloheptyl, dimethylcycloheptyl (including all structural isomers), methylethylcycloheptyl (including all structural isomers) and diethylcycloheptyl (including all structural isomers) groups; an aryl group such as phenyl and naphtyl groups; a $C_7$–$C_{18}$ alkylaryl group such as tolyl (including all structural isomers), xylyl (including all structural isomers), ethylphenyl (including all structural isomers), straight or branched propylphenyl (including all structural isomers), straight or branched butylphenyl (including all structural isomers), straight or branched pentylphenyl (including all structural isomers), straight or branched hexylphenyl (including all structural isomers), straight or branched heptylphenyl (including all structural isomers), straight or branched octylphenyl (including all structural isomers), straight or branched nonylphenyl (including all structural isomers), straight or branched decylphenyl (including all structural isomers), straight or branched undecylphenyl (including all structural isomers) and straight or branched dodecylphenyl (including all structural isomers) groups; a $C_7$–$C_{12}$ arylalkyl group such as benzyl, phenylethyl, phenylpropyl (including isomers of propyl group), phenylbutyl (including isomers of butyl group), phenylpentyl (including isomers of pentyl group) and phenylhexyl (including isomers of a hexyl group) groups.

In view of imparting the resulting traction drive fluid with excellent friction characteristics for a wet-type clutch, preferred phosphorus compounds (S-2) are acid phosphate represented by formula (45) wherein at least one of $R^{114}$ and $R^{115}$ is an hydrogen atom. Specific examples of the derivatives of (S-2) compound are salts obtained by allowing the acid phosphite of formula (45) wherein at least either one of $R^{114}$ and $R^{115}$ is a hydrogen atom or the acid phosphite of formula (46) wherein at least one of $R^{117}$ and $R^{118}$ is a hydrogen atom to react with a nitrogen-containing compound such as ammonia or an amine compound having in its molecules only a $C_1$–$C_8$ hydrocarbon group or hydroxyl-containing hydrocarbon group to neutralize the whole or part of the remaining acid hydrogen.

Such a nitrogen-containing compound may be exemplified by ammonium; alkylamine of which alkyl group may be straight or branched such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; an alkanolamine (an alkanol group thereof may be straight or branched) such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

In view of imparting the resulting traction drive fluid with excelled friction characteristics for a wet-type clutch, particularly preferred phosphorus compounds and derivatives thereof (S-2) are monolauryl phosphate, dilauryl phosphate, monostearyl phosphate, distearyl phosphate, monooleyl phosphate, dioleyl phosphate, monolauryl phosphate, dilauryl phosphite, monostearyl phosphite, distearyl phosphite, monooleyl phosphite, dioleylphosphite, monolauryl thiophosphate, dilauryl thiophosphate, monostearyl thiophosphate, distearyl thiophosphate, monooleyl thiophosphate, dioleyl thiophosphate, monolauryl thiophosphate, dilauryl thiophosphite, monostearyl thiophosphite, distearyl thiophosphite, monooleyl thiophosphite, dioleyl thiophosphite; amine salts (mono2-ethylhexylamine salts) of these phosphate, phosphite, thiophosphate and thiophosphite; and mixtures thereof.

The fatty acid of the fatty amide or fatty metal salt (S-3) may be straight or branched and saturated or unsaturated fatty acid but the alkyl and alkenyl groups should have 6–30, preferably 9–24 carbon atoms. The fatty acid if having the alkyl or alkenyl group of less than 6 carbon atoms or greater than 30 would deteriorate the friction characteristics for a wet-type clutch.

Specific examples of the fatty acid are saturated fatty acid such as straight or branched heptanoic acid, straight or branched octanonic acid, straight or branched nonanoic acid, straight or branched decanoic acid, straight or branched undecanoic acid, straight or branched dodecanoic acid, straight or branched tridecanoic acid, straight or branched tetradecanoic acid, straight or branched pentadecanoic acid, straight or branched hexadecanoic acid, straight or branched heptadecanoic acid, straight or branched octadecanoic acid, straight or branched nonadecanoic acid, straight or branched icosanoic acid, straight or branched henicosanoic acid, straight or branched docosanoic acid, straight or branched tricosanoic acid, straight or branched tetracosanoic acid, straight or branched pentacosanoic acid, straight or branched hexacosanoic acid, straight or branched heptacosanoic acid, straight or branched octacosanoic acid, straight or branched nonacosanoic acid and straight or branched triacontanoic acid; and unsaturated aliphatic acid such as straight or branched heptanoic acid, straight or branched octenoic acid, straight or branched nonenoic aicd, straight or branched decenoic acid, straight or branched undecenoic acid, straight or branched dodecenoic acid, straight or branched tridecenoic acid, straight or branched tetradecenoic acid, straight or branched pentadecenoic acid, straight or branched hexadecenoic acid, straight or branched heptadecenoic acid, straight or branched octadecenoic acid, straight or branched nonadecenoic acid, straight or branched eicosenoic acid, straight or branched heneicosenoic acid, straight or branched docosenoic acid, straight or branched tricosenoic acid, straight or branched tetracosenoic acid, straight or branched pentasenoic acid, straight or branched hexacosenoic acid, straight or branched heptacosenoic acid, straight or branched octacosenoic acid, straight or branched nonacosenoic acid and straight or branched triacontenoic acid. In view of superior friction characteristics imparted to a wet-type clutch, particularly preferred fatty acids are straight fatty acids derived from various types of fats and oils such as lauric acid, myristic acid, palmitic acid, stearic acid and oleic acid and mixtures of straight aliphatic acid and branched aliphatic acid obtained by oxo synthesis.

The fatty acid amide referred to as (S-3) may be amide obtained by reacting a nitrogen-containing compound such as ammonia and an amine compound having its molecules a $C_1$–$C_8$ hydrocarbon group or hydrocarbon group having hydroxyl groups with the above-described fatty acid or the acid chloride thereof.

Specific examples of such a nitrogen-containing compound are ammonia; alkylamine (the alkyl group may be straight or branched) such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; and alkanolamine (the alkanol group may be straight or branched) such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine.

In view of imparting a superior friction characteristics for a wet-type clutch, specific examples of the fatty acid amide (S-3) are lauric acid amide, lauric acid diethanolamide, lauric monopropanolamide, myristic acid amide, myristic acid diethanolamide, myristic acid monopropanolamide, palmitic acid amide, palmitic acid ethanolamide, palmitic acid monopropanolamide, stearic acid amide, stearic acid diethanolamide, stearic acid monopropanolamide, oleic acid amide, oleic acid diethanolamide, oleic acid monopropanol amide, coconut oil fatty amide, coconut oil fatty acid diethanolamide, coconut oil fatty monopropanolamide, $C_{12}$–$C_{13}$ synthetic mixed fatty amide, $C_{12}$–$C_{13}$ synthetic mixed fatty diethanolamide, $C_{12}$–$C_{13}$ synthetic mixed fatty monopropanolamide and mixtures thereof.

The fatty metallic salt (S-3) may be exemplified by alkaline earth metals of the above-exemplified fatty acids such as magnesium salt and calcium salt and zinc salt.

In view of imparting superior friction characteristics to a wet-type clutch, particularly preferred fatty metallic salts (S-3) are calcium laurate, calcium myristate, calcium palmitate, calcium stearate, calcium oleate, coconut oil fatty acid calcium, $C_{12}$–$C_{13}$ synthetic mixed fatty acid calcium, zinc laurate, zinc myristate, zinc palmitate, zinc stearate, zinc oleate, coconut oil fatty zinc, $C_{12}$–$C_{13}$ synthetic mixed fatty zinc and mixtures thereof.

Any one or more members arbitrary selected from the above-described Components (S) may be added to the inventive traction drive fluid in any suitable amount as long as they do not adversely affect the other performances of the resulting fluid such as oxidation stability. Since in order to improve the durability of friction characteristics, it is necessary to avoid Component (S) from deterioration leading to a deterioration in friction characteristics, the addition of a large amount of Component (S) is effective for an improvement in durability of the friction characteristics. However, too large amount of Component (S) would reduce static coefficient of friction which is required to be high so as to maintain the coupling of a wet-type clutch. The amount of Component (S) is thus limited.

In the case where there arises a necessity of adding Component (S) in an amount more than such limit so as to improve the durability of friction characteristics, there may be added an additive (Component Y) enhancing friction coefficient.

Component (Y) referred herein may be exemplified by the following compounds:

(Y-1) a compound having the same polar groups as those of Component (S) in the same molecule and the lipophilic group which is a hydrocarbon group having less than 100 carbon atoms; and (Y-2) a nitrogen-containing compound (succinimide- and succinamide-compounds) or a compound obtained by modifying the nitrogen-containing compound with a boron compound or a sulfur compound.

The inventive traction drive fluid is preferably added with a metallic detergent as well. Due to the addition of such a detergent (Component (T)), it becomes possible to optimize the friction characteristics of a wet-type clutch and restrict a reduction in strength thereof which reduction is caused by pressure being applied repeatedly.

Preferred metallic detergents are basic metallic detergents of 20–450 mgKOH/g, preferably 50–400 mgKOH/g in total base number. The term "total base number" referred herein designates total base number measured by perchloric acid potentiometric titration method in accordance with section 7 of JIS K2501 "Petroleum products and lubricants-Determination of neutralization number".

Metallic detergents if less than 20 mgKOH/g in total base number would be less effective in inhibiting the parts of a wet-type clutch from being reduced in strength due to the repeated compression applied thereto and if exceeding 450 mgKOH/g would be unstable in structure, leading to a deterioration in the storage stability of the resulting composition.

Component (T) may be one or more member selected from the following metal detergents:

(T-1) alkaline earth metal sulfonate of 20–450 mgKOH/g in total base number;

(T-2) alkaline earth metal phenate of 20–450 mgKOH/g in total base number; and (T-3) alkaline earth metal salicylate of 20–450 mgKOH/g in total base number.

Preferred alkaline earth metal sulfonate referred to as Component (T-1) may be alkaline earth metal salts of alkyl aromatic sulfonic acid obtained by sulfonating an alkyl aromatic compound having a molecular weight of 100–1,500, preferably 200–700. Particularly preferred are magnesium sulfonate and/or calcium sulfonate. The alkyl aromatic sulfonic acid may be petroleum sulfonic acid and synthetic sulfonate acids.

The petroleum sulfonic acid may be mahogany acid obtained by sulfonating the alkyl aromatic compound contained in the lubricant fraction of mineral oil or by-produced upon the production of white oil. The synthetic sulfonic acid may be those obtained by sulfonating alkyl benzene having a straight or branched alkyl group, which may be by-produced from a plant for producing alkyl benzene used as material of detergents, or sulfonating dinonylnaphthalene. Although not restricted, there may be used fuming sulfuric acid and sulfuric acid as a sulfonating agent.

The alkaline earth metal phenate referred to as (T-2) may be alkaline earth metal salts of alkylphenol having at least one straight or branched alkyl group of 4–30, preferably 6–18 carbon atoms, alkylphenolsulfide obtained by reacting the alkylphenol with elementary sulfur or a product resulting from Mannich reaction of the alkylphenol and formaldehyde. Particularly preferred are magnesium phenate and/or calcium phenate.

The alkaline earth metal salicylate referred to as Component (T-3) may be alkaline earth metal salts of alkyl salicylic acid having at least one straight or branched alkyl group of 4–30, preferably 6–18 carbon atoms. Particularly preferred are magnesium salicylate and/or calcium salicylate.

Components (T-1), (T-2) and (T-3) which are preferably 20–450 mgKOH/g in total base number may include normal salts obtained by directly reacting alkyl aromatic sulfonic acid, alkylpehnol, alkylpehnol sulfide, the Mannich reaction product thereof or alkyl salicylic acid with the oxide or hydride of the alkaline earth metals or by substituting any of these compounds having been converted to alkaline earth metal salts such as sodium salt or potassium salt with the alkaline earth metal salt. Furthermore, Components (T-1), (T-2) and (T-3) may be basic salts obtained by heating the normal salt and an alkaline earth metal salt or alkaline earth metal base (hydrides or oxides of an alkaline earth metal) in an excess amount in the presence of water and ultrabasic salts obtained by reacting the normal salt with an alkaline earth metal base in the presence of carbon dioxide.

These reactions may be carried out in a solvent, for example an aliphatic hydrocarbon solvent such as hexane, an aromatic hydrocarbon solvent such as xylene and a light lubricant base oil. Commercially available metallic detergents are usually diluted with a light lubricant base oil. It is preferred to use metallic detergents containing metal in an amount of 1.0–20 mass percent, preferably 2.0–16 mass percent.

Although not restricted, one or more of Components (T) may be added in an amount of 0.01–5.0 mass percent, preferably 0.05–4.0 mass percent. The amount of Component (T) if less than 0.01 mass percent would not be effective in inhibiting a wet-type clutch from being reduced in strength due to repeated compression and if greater than 5.0 mass percent would reduce the oxidation stability of the resulting composition.

With the above-described Components (Q), (P), (T) and (S), the inventive traction drive fluid can be imparted with wear resistance, oxidation stability and detergency needed for a hydraulic controlling mechanism and friction characteristics for a wet-type clutch needed for a friction characteristics controlling mechanism as well as the capability of providing the wet-type clutch with strength against repeatedly applied compression force. For the purpose of further enhancing these capabilities and improving the durability against nonferrous metals such as copper materials as well as durability of resins such as nylon, the inventive traction drive fluid may be added with antioxidants, extreme pressure agents, corrosion inhibitors, rubber swelling agents, antifoamers and colorants. These additives may be used singly or in combination.

Antioxidants may be phenol-based or amine-based compounds such as alkylphenols such as 2–6-di-tert-butyl-4-methylphenol, bisphenols such as methylene-4, 4-bisphenol (2,6-di-tert-butyl-4-methylphenol), naphtylamines such as phenyl-α-naphtylamine, dialkyldiphenylamines, zinc dialkyldithiophosphates such as zinc di-2-ethylhexyldithiophosphate, esters of 3,5-di-tert-butyl-4-hydroxyphenyl fatty acid (propionic acid) with a mono- or poly-hydric alcohol such as methanol, octadecanol, 1,6 hexanediol, neopentyl glycol, thiodiethylene glycol, triethylene glycol or pentaerythritol.

One or more of these compounds is preferably added in an amount of 0.01–5.0 mass percent.

Extreme pressure additives may be sulfur-containing compounds such as disulfides, olefin sulfides and sulfurized fats and oils. One or more of these compounds is preferably added in an amount of 0.1–5.0 mass percent.

Corrosion inhibitors may be benzotriazoles, tolyltriazoles, thiodiazoles and imidazoles. One or more of these compounds is preferably added in an amount of 0.01–3.0 mass percent.

Antifoamers may be silicones such as dimethylsilicone and fluorosilicone. One or more of these compounds is preferably added in an amount of 0.001–0.05 mass percent.

Colorants may be added in an amount of 0.001–1.0 mass percent.

The invention will be further described by way of the following examples which are provided only for illustrative purposes.

EXAMPLES

Naphthenic Hydrocarbon Tractant Drive Fluid A

There were prepared five types of traction drive fluids using the following formulations. Each of the traction drive fluids was measured of the traction coefficient and Brookfield viscosity at −30° C. The results are shown in Table 1.

Traction drive fluids A-1 through A-4 were naphthenic hydrocarbons (A) according to the invention. Traction coefficient was measured using a four roller traction coefficient testing machine. The test was conducted at a peripheral velocity of 3.14 m/s, an oil temperature of 100° C., a maximum Hertzian contact pressure of 1.49 GPa and a slip ratio of 2%.

Component A-1: 1,1-dicyclohexylethane

Component A-2: 1-(3,4-dimethylcyclohexyl)-1-cyclohexylethane

Component A-3: 1-(4-methylcyclohexyl)-1-cyclohexylethane

Component A-4: 1-(2,4-dimethylcyclohexyl)-1-cyclohexylethane

Component A-5: 1-(2,5-dimethylcyclohexyl)-1-cyclohexylethane

Component F: isobutenoligomer (number-average molecular weight: 330)

Component A-2 was prepared as follows:

A2 liter flask was charged with 1,200 g of o-xylene and 150 g of sulfuric acid and cooled from the outside with ice, followed by addition of the mixture of 500 cc of styrene and 400 cc of o-xylene while stirring. During this procedure, the reaction temperature was maintained at below 10° C. After one-hour stirring, the reaction was completed. The resulting product was washed with a NaOH aqueous solution and then with water. The product was then dehydrated and subjected to vacuum distillation thereby obtaining a styrene adduct of xylene. One liter of this adduct was placed into a 2 liter autoclave and added with 30 g of nickel/diatomaceous earth catalyst. The mixture was hydrogenated at a temperature of 170° C. and hydrogen pressure of 70 atm thereby obtaining the intended product.

In the method similar to the foregoing, Components A-3 through A-5 were synthesized. Component A-1 was obtained by hydrogenating a commercially available 1,1-diphenylethane

TABLE 1

| | | Traction Coefficient | Brookfield Viscosity @ −30° C. mPa · s | Brookfiled Viscosity @ −40° C. mPa · s |
|---|---|---|---|---|
| Fluid A-1 | Component A-1 | 0.070 | 110 | Solidified |
| Fluid A-2 | Component A-2 | 0.080 | 1600 | 5900 |
| Fluid A-3 | Component A-3 | 0.070 | 160 | 550 |
| Fluid A-4 | Component A-4 | 0.083 | 1800 | 15400 |
| Fluid A-5 | Component A-5 | 0.085 | 4400 | 61700 |
| Fluid 1 | Component F | 0.061 | 4500 | 31500 |

2-methyl-2,4-dimethylcyclohexylpentane was used as a synthetic base oil (Component B-3) Traction coefficient and Brookfield viscosity at −30° C. were measured for Fluids A-5 through A-7 and Fluids 1–4 prepared in accordance with the formulations shown in Table 2. The results are also shown in Table 2.

TABLE 2

| | Blend Ratio % | | | | Brookfiled |
|---|---|---|---|---|---|
| | Component B-3 | Component A-5 | Component F | Traction Coefficient | Viscosity @ −30° C. MPa · s |
| Fluid 2 | 100 | | | 0.089 | 30000 |
| Fluid A-6 | 90 | 10 | | 0.088 | 25000 |
| Fluid 3 | 90 | | 10 | 0.085 | 25000 |
| Fluid A-7 | 50 | 50 | | 0.087 | 10000 |
| Fluid 4 | 50 | | 50 | 0.075 | 10000 |
| Fluid A-5 | | 100 | | 0.085 | 4400 |
| Fluid 1 | | | 100 | 0.061 | 4500 |

Fluids A-8 through A-10 were prepared by mixing Fluid A-5 with each of polymethacrylate (PMA), polyisobutylene and ethylene-α-olefin copolymer (OCP). Fluids A-5 and A-8 through A-10 were measured of kinematic viscosity at 100° C., Brookfield viscosity at low temperature (−30° C.) and traction coefficient, respectively. The results are shown in Table 3 below. The number-average molecular weight (Mn) and amount of PMA, PIB and OCP were as follows:

PMA: Mn 18,000, 8.5 mass %, PIB: Mn 2,700, 7.6 mass %

OCP: Mn 9,900, 3.2 mass %

TABLE 3

| Viscosity Index Improver | | Kinematic Viscosity @ 100° C. $mm^2/s$ | Brookfield Viscosity @ −30° C. mPa · s | Traction Coefficient |
|---|---|---|---|---|
| Fluid A-3 | None | 2.2 | 4400 | 0.085 |
| Fluid A-8 | PMA | 5.0 | 5300 | 0.077 |
| Fluid A-9 | PIB | 5.0 | 8100 | 0.083 |
| Fluid A-10 | OCP | 5.0 | 5500 | 0.083 |

Six types of fluids (Fluids A-11 through A-16) were prepared by mixing Fluid A-5 with an ashless dispersant and a phosphorus-containing additive in accordance with the formulation shown in Table 4 below. Each of the fluids was evaluated in abrasion resistance and oxidation stability. The results are shown in Table 4.

TABLE 4

| | | | Fluid A-11 | Fluid A-12 | Fluid A-13 | Fluid A-14 | Fluid A-15 | Fluid A-16 |
|---|---|---|---|---|---|---|---|---|
| Base oil | Component A-5 | | 97.35 | 97.35 | 93.65 | 96.30 | 93.80 | 96.15 |
| Viscosity Index Improver | OCP | | | | 3.2 | 3.2 | 3.2 | 3.2 |
| Additives | Component Q | Ashless Dispersant A | 1.5 | | 1.5 | | 1.5 | |
| | | Ashless Dispersant B | 1.0 | 2.5 | 1.0 | | 1.0 | |
| | Component P | Phosphorus-containing Additive A | 0.15 | 0.15 | 0.15 | | | 0.15 |
| | Oxidation Inhibitor (bisphenol) | | | | 0.5 | 0.5 | 0.5 | 0.5 |
| Vane Pump Test (ASTM D2882; 80° C., 6.9 Mpa) | | | | | 13.3 | | 854.4 | |
| Abrasion Wear, mg | | | | | | | | |
| ISOT (JIS K2514; 150° C., 96 h) | | | 0.42 | 0.51 | 0.37 | 0.66 | 0.23 | 1.02 |
| Total Acid Value Increase, mg KOH/g | | | | | | | | |
| Lacquer Rating(deposit) | | | none | none | none | medium | none | dark |
| n-petane insoluble, mass % | | | 0.00 | 0.00 | 0.00 | 0.15 | 0.00 | 0.45 |

ASTM D2882: Indicating the Wear Characteristics of Petroleum and Non-Petroleum Hydraulic Fluids in a Constant Volume Vane Pump JIS K2514: Lubricating oil-Determination of oxidation stability Ashless Dispersant A: alkenylsuccinimide (number-average molecular weight: 5,500)

Ashless Dispersant B: boron-modified alkenylsuccinimide (number-average molecular weight: 4,500)

Phosphorus-containing Additive A: diphenylhydrogenphosphite

Fluids A-17 through A-22 were prepared in accordance with the formulations indicated in Table 5. The dependence of friction coefficient on slipping speed of each fluid was measured using a low velocity slip testing machine in accordance with JASO M349-95 "Automatic transmission fluid-determination of shudder inhibition capability" under the following conditions.

Oil amount: 0.2 L, Oil temperature: 80° C., Surface pressure: 0.98 Mpa

The results are shown in Table 5 below.

TABLE 5

| | | Fluid A-17 | Fluid A-18 | Fluid A-19 | Fluid A-20 | Fluid A-21 | Fluid A-5 | Fluid A-22 |
|---|---|---|---|---|---|---|---|---|
| Base oil | Component A-5 | 99.85 | 99.85 | 99.50 | 99.50 | 93.50 | 100 | 94.15 |
| Viscosity Index Improver | OCP | | | | | 3.2 | | 3.2 |
| Component Q | Ashless Dispersant A | | | | | 1.5 | | 1.5 |
| | Ashless Dispersant B | | | | | 1.0 | | 1.0 |
| Component P | Phosphorus-containing Additive A | | | | | 0.15 | | 0.15 |
| Component S | Ethoxylated Oleyl Amine | 0.15 | | | | 0.15 | | |
| | Oleyl Amine | | 0.15 | | | | | |
| Component T | Mg Sulfonate A | | | 0.5 | | | | |
| | Ca Sulfonate A | | | | 0.5 | 0.5 | | |
| Speed Dependency of Friction Coefficient $\mu$(0.12 cm/s)/$\mu$(0.3 cm/s). | | 0.84 (Positive Gradient) | 0.90 (Positive Gradient) | 0.93 (Positive Gradient) | 0.98 (Positive Gradient) | 0.80 (Positive Gradient) | 1.52 (Negative Gradient) | 1.12 (Negative Gradient) |

Mg sulfonate A: petroleum-based, total base number (perchloric method): 300 mgKOH/g Ca sulfonate A: petroleum-based, total base number (perchloric method): 300 mgKOH/g Four types of fluids (Fluids A-23–A26) were prepared in accordance with the formulations shown in Table 6. Each of Fluids A-23 through A-26 was examined in effect of additives exerting on strength of a wet-type clutch against repeatedly-applied compression. The wet-type clutch was repeatedly compressed under the conditions given below using a stroke testing machine till the surface of the friction material peels off. The effect was evaluated by counting the number of stroke cycle taken until the peel-off occurred. The results are shown in Table 6.

Test Condition

Friction material: cellulose material Surface pressure: 9.8 Mpa

Oil temperature: 120° C. One cycle: Press 3 sec. Release 7 sec.

TABLE 6

| | | Fluid A-23 | Fluid A-24 | Fluid A-25 | Fluid A-26 |
|---|---|---|---|---|---|
| Base Oil | Component A-5 | 97.15 | 93.50 | 97.15 | 97.35 |
| Viscosity Index Improver | OCP | | 3.2 | | |
| Component Q | Ashless Dispersant A | 1.5 | 1.5 | 1.5 | 1.5 |
| | Ashless Dispersant B | 1.0 | 1.0 | 1.0 | 1.0 |
| Component P | Phosphorus-containing Additive A | 0.15 | 0.15 | 0.15 | 0.15 |
| Component T | Ca Sulfonate A | | 0.5 | | |
| | Ca Sulfonate B | 0.2 | | | |
| Component S | Ethoxylated Oleyl Amine | | 0.15 | | |
| Ca Sulfonate C | | | | 0.2 | |
| the No. of cycles taken until the occurrence of peel-off | | 15.3 | 14.8 | 6.2 | 4.2 |

Ca sulfonate B: petroleum-based, total base number (perchloric method): 400 mgKOH/g Ca sulfonate C: petroleum-based, total base number (perchloric method): 13 mgKOH/g Naphthenic Hydrocarbon Traction Drive Fluid B There were prepared five types of traction drive fluids using in accordance with the formulations in Table 7. Each of the traction drive fluids was measured of the traction coefficient. The results are shown in Table 7 given below.

Traction drive fluids B-1 through B-4 were naphthenic hydrocarbons (B) according to the invention.

The measurement of traction coefficient was conducted in accordance with the same procedures and conditions as conducted for the above examples of naphthenic hydrocarbon Traction drive fluid A.

Component B-1: 2,4-dicyclohexylpentane

Component B-2: 1,3-dicyclohexyl-3-methylbutane

Component B-3: 2-methyl-2,4-dicyclohexylpentane

Component B-4: 2,4-bis(2-methyl-cyclohexyl)-2-methylpentane

Component G: 1,3-dicyclohexylbutane

TABLE 7

| | | Traction Coefficient |
|---|---|---|
| Fluid B-1 | Component B-1 | 0.083 |
| Fluid B-2 | Component B-2 | 0.085 |
| Fluid B-3 | Component B-3 | 0.089 |
| Fluid B-4 | Component B-4 | 0.093 |
| Fluid 5 | Component G | 0.068 |
| Fluid 1 | Component F | 0.061 |

1-(2,5-dimethylcyclohexyl)-1-cyclohexylethane was used as a synthetic base oil (Component A-4). The traction coefficient and Brookfield viscosity at −30° C. were measure for Fluids B-1, B-5 and B-6 and Fluids 1 and 6 through 8 prepared in accordance with the formulation in Table 8. The results are shown in Table 8.

TABLE 8

| | Blend Ratio % | | | | Brookfield |
|---|---|---|---|---|---|
| | Component A-4 | Component B-1 | Component F | Traction Coefficient | Viscosity @ −30° C. MPa · s |
| Fluid 6 | 100 | | | 0.085 | 4400 |
| Fluid B-5 | 90 | 10 | | 0.085 | 4000 |
| Fluid 7 | 90 | | 10 | 0.083 | 4400 |
| Fluid B-6 | 50 | 50 | | 0.084 | 3500 |
| Fluid 8 | 50 | | 50 | 0.073 | 4500 |
| Fluid B-1 | | 100 | | 0.083 | 3300 |
| Fluid 1 | | | 100 | 0.061 | 4500 |

Fluids B-7 through B-9 were prepared by mixing Fluid B-3 with each of polymethacrylate (PMA), polyisobutylene and ethylene-α-olefin copolymer (OCP). Fluids B-3 and B-7 through B-9 were measured for kinematic viscosity at 100° C., Brookfield viscosity at low temperature (−30° C.) and traction coefficient, respectively. The results are shown in Table 3 below. The number-average molecular weight (Mn) and amount of PMA, PIB and OCP were as follows:

PMA: Mn 18,000, 4.8 mass %, PIB: Mn 2,700, 4.3 mass %

OCP: Mn 9,900, 1.8 mass %

TABLE 9

| Viscosity Index Improver | | Kinematic Viscosity @ 100° C. $mm^2/s$ | Brookfield Viscosity at a low temperature @ −30° C. mPa · s | Traction Coefficient |
|---|---|---|---|---|
| Fluid B-3 | none | 3.6 | 30000 | 0.089 |
| Fluid B-7 | PMA | 5.0 | 36000 | 0.082 |
| Fluid B-8 | PIB | 5.0 | 59000 | 0.087 |
| Fluid B-9 | OCP | 5.0 | 37000 | 0.087 |

Six types of fluids (Fluids B-10 through B-15) were prepared by mixing Traction drive fluid B-3 with an ashless dispersant and a phosphorus-containing additive in accordance with the formulation shown in Table 10 below. Each of the Fluids was evaluated in abrasion resistance and oxidation stability. The results are shown in Table 10.

TABLE 10

| | | | Fluid B-10 | Fluid B-11 | Fluid B-12 | Fluid B-13 | Fluid B-14 | Fluid B-15 |
|---|---|---|---|---|---|---|---|---|
| Base oil | Component B-3 | | 97.35 | 97.35 | 95.05 | 97.70 | 95.20 | 97.55 |
| Viscosity Index Improver | OCP | | | | 1.8 | 1.8 | 1.8 | 1.8 |
| Additives | Component Q | Ashless Dispersant A | 1.5 | | 1.5 | | 1.5 | |
| | | Ashless Dispersant B | 1.0 | 2.5 | 1.0 | | 1.0 | |
| | Component P | Phosphorus-containing Additive A | 0.15 | 0.15 | 0.15 | | | 0.15 |
| | Oxidation Inhibitor (bisphenol) | | | | 0.5 | 0.5 | 0.5 | 0.5 |
| Vane Pump Test (ASTM D2882; 80° C., 6.9 Mpa) | | | | | 12.1 | | 912.3 | |
| Abrasion Wear, mg ISOT (JIS K2514; 150° C., 96 h) | | | 0.39 | 0.45 | 0.32 | 0.57 | 0.21 | 0.97 |
| Total Acid Value Increase, mg KOH/g | | | | | | | | |
| Lacquer Rating (deposit) | | | none | none | none | medium | none | dark |
| n-petane insoluble, mass % | | | 0.00 | 0.00 | 0.00 | 0.14 | 0.00 | 0.52 |

Fluids B-16 through B-21 were prepared in accordance with the formulations indicated in Table 11. The dependence of friction coefficient on slipping speed of each fluid was measured in accordance with the same manner and conditions as the foregoing. The results are shown in Table 11 below.

TABLE 11

| | | Fluid B-16 | Fluid B-17 | Fluid B-18 | Fluid B-19 | Fluid B-20 | Fluid B-3 | Fluid B-21 |
|---|---|---|---|---|---|---|---|---|
| Base oil | Component B-3 | 99.85 | 99.85 | 99.50 | 99.50 | 94.90 | 100 | 95.55 |
| Viscosity Index Improver | OCP | | | | | 1.8 | | 1.8 |
| Component Q | Ashless Dispersant A | | | | | 1.5 | | 1.5 |
| | Ashless Dispersant B | | | | | 1.0 | | 1.0 |
| Component P | Phosphorus-containing Additive A | | | | | 0.15 | | 0.15 |
| Component S | Ethoxylated Oleyl Amine | 0.15 | | | | 0.15 | | |
| | Oleyl Amine | | 0.15 | | | | | |
| Component T | Mg Sulfonate A | | | 0.5 | | | | |
| | Ca Sulfonate A | | | | 0.5 | 0.5 | | |
| Speed Dependency of Friction Coefficient $\mu$(0.12 cm/s)/$\mu$(0.3 cm/s). | | 0.82 (Positive Gradient) | 0.87 (Positive Gradient) | 0.92 (Positive Gradient) | 0.96 (Positive Gradient) | 0.79 (Positive Gradient) | 1.61 (Negative Gradient) | 1.10 (Negative Gradient) |

Four types of fluids (Fluids B-22–B-25) were prepared in accordance with the formulations shown in Table 12. Each of Fluids B-22 through B-25 was examined in effect of additives exerting on strength of a wet-type clutch against repeated-applied compression. The wet-type clutch was repeatedly compressed under the same conditions as conducted for the above Fluids A-23 through A-26. The effect was evaluated by counting the number of stroke cycle taken until the peel-off occurred. The results are shown in Table 12.

TABLE 12

| | | Fluid B-22 | Fluid B-23 | Fluid B-24 | Fluid B-25 |
|---|---|---|---|---|---|
| Base Oil | Component B-3 | 97.15 | 94.90 | 97.15 | 97.35 |
| Viscosity Index Improver | OCP | | 1.8 | | |
| Component Q | Ashless Dispersant A | 1.5 | 1.5 | 1.5 | 1.5 |
| | Ashless Dispersant B | 1.0 | 1.0 | 1.0 | 1.0 |
| Component P | Phosphorus-containing Additive A | 0.15 | 0.15 | 0.15 | 0.15 |
| Component T | Ca Sulfonate A | | 0.5 | | |
| | Ca Sulfonate B | 0.2 | | | |
| Component S | Ethoxylated Oleyl Amine | | 0.15 | | |
| Ca Sulfonate C | | | | 0.2 | |
| the No. of cycles taken until the occurrence of peel-off | | 16.2 | 15.4 | 5.8 | 4.9 |

Naphthenic Carboxylate Traction Drive Fluid C

There was synthesized traction drive fluid C-5 in Table 13 below which is one typical example of naphthenic carboxylates (C) according to the invention represented by the formula (47)

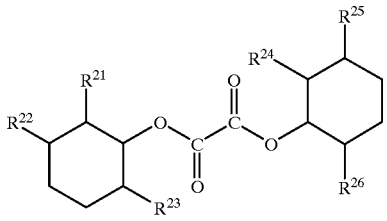

wherein $R^{21}$ and $R^{24}$ each are methyl group and $R^{22}$, $R^{23}$, $R^{25}$ and $R^{26}$ each are a hydrogen atom, in the following manner.

1713 g of 2-methylcyclohexanol and 5.8 g of metallic sodium were placed into a 2 L round flask and heated at a temperature of 120 with nitrogen blow. After the mixture became a homogeneous solution by the reaction of the metallic sodium with the cyclohexanol, it was added with droplets of 886 g of dimethyl oxylate over 4 hours. The reaction was completed after heating at 150° C. for 3 hours. The methanol produced by the reaction was trapped for preventing it from returning to the flask. The reaction product was washed with water until it became neutral and dehydrated, followed by distillation under reduced pressure thereby obtaining di-2-methylcyclohexyloxalate which is encompassed by naphthenic carboxylate (C) traction drive fluid according to the invention. The final yield was about 80%.

Traction drive fluids C-1 through C-4, C-6 and C-7 each having the structure shown in Table 13 were synthesized in accordance with the above synthesizing method.

TABLE 13

| | Formula (47) | | | | | |
|---|---|---|---|---|---|---|
| Sample | $R^{21}$ | $R^{22}$ | $R^{23}$ | $R^{24}$ | $R^{25}$ | $R^{26}$ |
| Fluid C-1 | H | H | H | H | H | H |
| Fluid C-2 | H | $CH_3$ | H | H | $CH_3$ | H |
| Fluid C-3 | $CH_3$ | H | H | H | H | H |
| Fluid C-4 | $CH_3$ | H | $CH_3$ | H | H | H |
| Fluid C-5 | $CH_3$ | H | H | $CH_3$ | H | H |
| Fluid C-6 | $CH_3$ | H | $CH_3$ | $CH_3$ | H | H |
| Fluid C-7 | $CH_3$ | H | $CH_3$ | $CH_3$ | H | $CH_3$ |

The measurement of traction coefficient was conducted for traction drive fluids C-1, C-2, C-5 and C-7, traction drive fluids C-8 through C-10 which were prepared in accordance with the formulations shown in Table 14 and commercially available traction drive fluid "SANTOTRAC 50" which has been used in the industrial machinery field and known to have high traction coefficient. The results are shown in Table 14. The traction coefficient of each traction drive fluids C-3, C-4 and C-6 was calculated based on those of other traction drive fluids.

The measurement was conducted in the same manner as conducted for the above examples of naphthenic hydrocarbon (A).

TABLE 14

| Sample | Traction Coefficient |
|---|---|
| Fluid C-1 | 0.089 |
| Tractant Fluid C-2 | 0.087 |
| Fluid C-5 | 0.092 |
| Fluid C-7 | 0.094 |
| Fluid C-8 (Volume Ratio: Fluid C-1/Fluid C-3/Fluid C-5 = 23/48/29) | 0.090 |
| Fluid C-9 (Volume Ratio: Fluid C-1/Fluid C-4/Fluid C-7 = 26/47/27) | 0.091 |
| Fluid C-10 (Volume Ratio: Fluid C-5/Fluid C-6/Fluid C-7 = 28/45/27) | 0.093 |
| Fluid C-3 (*Note 1) | 0.090 |
| Fluid C-4 (*Note 2) | 0.090 |
| Fluid C-6 (*Note 3) | 0.093 |
| Fluid 9 SANTOTRAC 50 | 0.087 |

Note 1: the value calculated from the traction coefficient of traction drive fluids C-1, C-5 and C-8 assuming that additivity can be applied to traction coefficient;
Note 2: the value calculated from the traction coefficient of traction drive fluids C-1, C-7 and C-9 assuming that additivity can be applied to traction coefficient;
Note 3: the value calculated from the traction coefficient of traction drive fluids C-5, C-7 and C-10 assuming that additivity can be applied to traction coefficient 2-methyl-2,4-dicyclohexylpentane was used as a synthetic base oil (Component B-3). The traction coefficient and Brookfield viscosity at −30° C. were measure for Fluids C-5, C-11, C-12 and Fluids 1–4 prepared in accordance with the formulations shown in Table 15. The results are shown in Table 15.

TABLE 15

| | Blend Ratio % | | | | Brookfield |
|---|---|---|---|---|---|
| | Component F | Component C-5 | Component B-3 | Traction Coefficient | Viscosity @ −30° C. MPa · s |
| Fluid 1 | 100 | | | 0.061 | 4500 |
| Fluid C-11 | 50 | 50 | | 0.077 | 9400 |
| Fluid 4 | 50 | | 50 | 0.075 | 12000 |
| Fluid C-12 | 10 | 90 | | 0.089 | 12000 |
| Fluid 3 | 10 | | 90 | 0.085 | 25000 |
| Fluid C-5 | | 100 | | 0.092 | 16000 |
| Fluid 2 | | | 100 | 0.089 | 30000 |

Fluids C-13 through C-15 were prepared by mixing Fluid C-5 with each of polymethacrylate (PMA), polyisobutylene and ethylene-α-olefin copolymer (OCP). Fluids C-5 and C-13 through C-15 were measured of kinematic viscosity at 100° C., low temperature (−30° C.) viscosity and traction coefficient, respectively. The results are shown in Table 16 below. The number-average molecular weight (Mn) and amount of each PMA, PIB and OCP were as follows:

PMA: Mn 18,000, 6.7 mass %, PIB: Mn 2,700, 6.0 mass %

OCP: Mn 9,900, 2.5 mass %

TABLE 16

| | Kinematic Viscosity @ | Brookfield Viscosity at a low |
|---|---|---|

| | Additives | 100° C. $mm^2/s$ | temperature @ −30° C. mPa · s | Traction Coefficient |
|---|---|---|---|---|
| Fluid C-5 | none | 3.1 | 16000 | 0.092 |
| Fluid C-13 | PMA | 5.0 | 20000 | 0.085 |
| Fluid C-14 | PIB | 5.0 | 31000 | 0.090 |
| Fluid C-15 | OCP | 5.0 | 21000 | 0.090 |

Six types of fluids (Fluids C-16 through C-21) were prepared by mixing Traction drive fluid C-5 with an ashless dispersant and a phosphorus-containing additive in accordance with the formulation shown in Table 17 below. Each of the fluids was evaluated in abrasion resistance and oxidation stability. The results are shown in Table 17.

TABLE 17

| | | | Fluid C-16 | Fluid C-17 | Fluid C-18 | Fluid C-19 | Fluid C-20 | Fluid C-21 |
|---|---|---|---|---|---|---|---|---|
| Base oil | Component C-5 | | 9735 | 97.35 | 94.05 | 97.00 | 94.50 | 96.85 |
| Viscosity Index Improver | OCP | | | | 2.5 | 2.5 | 2.5 | 2.5 |
| Additives | Component Q | Ashless Dispersant A | 1.5 | | 1.5 | | 1.5 | |
| | | Ashless Dispersant B | 1.0 | 2.5 | 1.0 | | 1.0 | |
| | Component P | Phosphorus-containing Additive A | 0.15 | 0.15 | 0.15 | | | 0.15 |
| | | Oxidation Inhibitor (bisphenol) | | | 0.5 | 0.5 | 0.5 | 0.5 |
| Vane Pump Test (ASTM D2882; 80° C., 6.9 Mpa) | | | | | 12.5 | | 810.6 | |
| Abrasion Wear, mg ISOT (JIS K2514; 150° C., 96 h) | | | 0.36 | 0.43 | 0.30 | 0.62 | 0.20 | 0.89 |
| Total Acid Value Increase, mg KOH/g | | | | | | | | |
| Lacquer Rating (deposit) | | | none | none | none | medium | none | dark |
| n-petane insoluble, mass % | | | 0.00 | 0.00 | 0.00 | 0.14 | 0.00 | 0.52 |

Fluids C-22 through C-27 were prepared in accordance with the formulations indicated in Table 18. The dependence of friction coefficient on slipping speed of each fluid was measured in accordance with the same manner and conditions as the foregoing. The results are shown in Table 18 below.

TABLE 18

| | | Fluid C-22 | Fluid C-23 | Fluid C-24 | Fluid C-25 | Fluid C-26 | Fluid C-5 | Fluid C-27 |
|---|---|---|---|---|---|---|---|---|
| Base oil | Component C-5 | 99.85 | 99.85 | 99.50 | 99.50 | 94.20 | 100 | 94.85 |
| Viscosity Index Improver | OCP | | | | | 2.5 | | 2.5 |
| Component Q | Ashless Disperesant A | | | | | 1.5 | | 1.5 |
| | Ashless Dispersant B | | | | | 1.0 | | 1.0 |
| Component P | Phosphorus-containing Additive A | | | | | 0.15 | | 0.15 |
| Component S | Ethoxylated Oleyl Amine | 0.15 | | | | 0.15 | | |
| | Oleyl Amine | | 0.15 | | | | | |
| Component T | Mg Sulfonate A | | | 0.5 | | | | |
| | Ca Sulfonate A | | | | 0.5 | 0.5 | | |
| Speed Dependency of Friction Coefficient $\mu$(0.12 cm/s)/$\mu$(0.3 cm/s). | | 0.88 (Positive Gradient) | 0.91 (Positive Gradient) | 0.94 (Positive Gradient) | 0.97 (Positive Gradient) | 0.86 (Positive Gradient) | 1.71 (Negative Gradient) | 1.15 (Negative Gradient) |

Four types of fluids (Fluids C-16 and C-28–C-30) were prepared in accordance with the formulations shown in Table 19. Each of Fluids C-28 through C-30 was examined in effect of additives exerting on strength of a wet-type clutch against repeated-applied compression. The wet-type clutch was repeatedly compressed under the same conditions as conducted for the above Fluids A-23 through A-26. The effect was evaluated by counting the number of stroke cycle taken until the peel-off occurred. The results are shown in Table 19.

TABLE 19

| | | Fluid C-28 | Fluid C-29 | Fluid C-30 | Fluid C-16 |
|---|---|---|---|---|---|
| Base Oil | Component C | 97.15 | 94.20 | 97.15 | 97.35 |
| Viscosity Index Improver | OCP | | 2.5 | | |
| Component Q | Ashless Dispersant A | 1.5 | 1.5 | 1.5 | 1.5 |
| | Ashless Dispersant B | 1.0 | 1.0 | 1.0 | 1.0 |
| Component P | Phosphorus-containing Additive A | 0.15 | 0.15 | 0.15 | 0.15 |
| Component T | Ca Sulfonate A | | 0.5 | | |
| | Ca Sulfonate B | 0.2 | | | |
| Component S | Ethoxylated Oleyl Amine | | 0.15 | | |
| Ca Sulfonate C | | | | 0.2 | |
| the No. of cycles taken until the occurrence of peel-off | | 15.8 | 15.0 | 6.6 | 5.2 |

Naphthenic Carboxylate (D)

There was synthesized traction drive fluid D-1 in Table 20 which is one typical example of naphthenic carboxylates (D) of the invention represented by the formula (48)

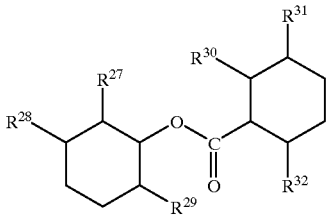

wherein $R^{27}$ through $R^{32}$ each are a hydrogen atom, in the following manner.

650 g of cyclohexane carboxylic acid, 750 g of cyclohexanol and 15 g of phosphoric acid were placed into a 2 L round flask and heated at 190 ° C. with nitrogen blow. The water produced by the esterification was trapped so as not to return to the flask. The reaction was completed after 20 hours. The reaction product was washed with an aqueous solution of sodium hydroxide until being alkalized, followed by the removal of the unreacted cyclohexane carboxylic acid and phosphoric acid. The residue was then washed with water until being neutralized and dehydrated, followed by distillation under reduced pressure thereby obtaining cyclohexanolecyclohexanecarboxylate. The final yield was about 80%.

Traction drive fluids D-2 through D-9 each having the structure shown in Table 20 were synthesized in accordance with the above synthesizing method.

Traction drive fluids D-1 through D-9 and Comparative Traction drive fluid 1 (isobutene oligomer) were measured of traction coefficient with the results shown in Table 20 below. The measurement was conducted in the same manner as conducted for the above examples of naphthenic hydrocarbon (A).

TABLE 20

| | Formula (48) | | | | | | Traction |
|---|---|---|---|---|---|---|---|
| Sample | $R^{27}$ | $R^{28}$ | $R^{29}$ | $R^{30}$ | $R^{31}$ | $R^{32}$ | Coefficient |
| Fluid D-1 | H | H | H | H | H | H | 0.086 |
| Fluid D-2 | H | $CH_3$ | H | H | H | H | 0.085 |
| Fluid D-3 | $CH_3$ | H | H | H | H | H | 0.088 |
| Fluid D-4 | $CH_3$ | H | $CH_3$ | H | H | H | 0.089 |
| Fluid D-5 | $CH_3$ | H | H | $CH_3$ | H | H | 0.090 |
| Fluid D-6 | H | H | H | $CH_3$ | H | $CH_3$ | 0.089 |
| Fluid D-7 | $CH_3$ | H | $CH_3$ | $CH_3$ | H | H | 0.091 |
| Fluid D-8 | $CH_3$ | H | H | $CH_3$ | H | $CH_3$ | 0.091 |
| Fluid D-9 | $CH_3$ | H | $CH_3$ | $CH_3$ | H | $CH_3$ | 0.092 |
| Fluid 1 | Component F (Isobutene Oligomer) | | | | | | 0.061 |

2-methyl-2,4-dicyclohexylpentane was used as a synthetic base oil (Component B-3). The traction coefficient and Brookfield viscosity at −30° C. were measure for Fluids D-3, D-10, D-11 and Fluids 1–4 prepared by using Fluid D-3, Component F and Component B-3 in accordance with the formulations shown in Table 21. The results are shown in Table 21.

TABLE 21

| | Blend Ratio % | | | | Brookfield |
|---|---|---|---|---|---|
| | Component B-3 | Component D-3 | Component F | Traction Coefficient | Viscosity @ −30° C. mPa · s |
| Fluid 2 | 100 | | | 0.089 | 30000 |
| Fluid D-10 | 90 | 10 | | 0.089 | 17000 |
| Fluid 3 | 90 | | 10 | 0.085 | 25000 |
| Fluid D-11 | 50 | 50 | | 0.089 | 3300 |
| Fluid 4 | 50 | | 50 | 0.075 | 10000 |
| Fluid D-3 | | 100 | | 0.088 | 360 |
| Fluid 1 | | | 100 | 0.061 | 4500 |

Fluids D-12 through D-14 were prepared by mixing Fluid D-3 with each of polymethacrylate (PMA), polyisobutylene and ethylene-α-olefin copolymer (OCP). Fluids D-12 through D-14 and D-3 were measured of kinematic viscosity at 100° C., low temperature (−30° C.) viscosity and traction coefficient, respectively, The results are shown in Table 22 below. The number-average molecular weight (Mn) and amount of PMA, PIB and OCP were as follows:

PMA:Mn 18,000, 9.3 mass %, PIB:Mn 2,700, 8.4 mass %

OCP:Mn 9,900, 3.5 mass %

TABLE 22

| | Additive | Kinematic Viscosity @ 100° C. $mm^2/s$ | Brookfield Viscosity at a low temperature @ −30° C. mPa · s | Traction Coefficient |
|---|---|---|---|---|
| Fluid D-3 | None | 1.9 | 360 | 0.088 |
| Fluid D-12 | PMA | 5.0 | 440 | 0.081 |
| Fluid D-13 | PIB | 5.0 | 810 | 0.086 |
| Fluid D-14 | OCP | 5.0 | 450 | 0.086 |

Six types of fluids (Fluids D-15 through D-20) were prepared by mixing traction drive fluid D-3 with an ashless dispersant and a phosphorus-containing additive in accordance with the formulation shown in Table 23 below. Each of the fluids was evaluated in abrasion resistance and oxidation stability. The results are shown in Table 23.

TABLE 23

| | | | Fluid D-15 | Fluid D-16 | Fluid D-17 | Fluid D-18 | Fluid D-19 | Fluid D-20 |
|---|---|---|---|---|---|---|---|---|
| Base oil | Component D-3 | | 97.35 | 97.35 | 94.05 | 97.00 | 94.50 | 96.85 |
| Viscosity Index Improver | OCP | | | | 3.5 | 3.5 | 3.5 | 3.5 |
| Additives | Component Q | Ashless Dispersant A | 1.5 | | 1.5 | | 1.5 | |
| | | Ashless Dispersant B | 1.0 | 2.5 | 1.0 | | 1.0 | |
| | Component P | Phosphorus-containing Additive A | 0.15 | 0.15 | 0.15 | | | 0.15 |
| | Oxidation Inhibitor (bisphenol) | | | | 0.5 | 0.5 | 0.5 | 0.5 |
| Vane Pump Test (ASTM D2882; 80° C., 6.9 Mpa) | | | | | 25.2 | | 983.4 | |
| Abrasion Wear, mg | | | | | | | | |
| ISOT (JIS K2514; 150° C., 96 h) | | | 0.49 | 0.52 | 0.42 | 0.71 | 0.31 | 0.98 |
| Total Acid Value Increase, mg KOH/g | | | | | | | | |
| Lacquer Rating (deposit) | | | none | none | none | medium | none | dark |
| n-petane insoluble, mass % | | | 0.00 | 0.00 | 0.00 | 0.13 | 0.00 | 0.37 |

Fluids D-21 through D-26 were prepared in accordance with the formulations indicated in Table 24. The dependence of friction coefficient on slipping speed of each fluid was measured in accordance with the same manner and conditions as the foregoing. The results are shown in Table 24 below.

TABLE 24

| | | Fluid D-21 | Fluid D-22 | Fluid D-23 | Fluid D-24 | Fluid D-25 | Fluid D-3 | Fluid D-26 |
|---|---|---|---|---|---|---|---|---|
| Base oil | Component D-3 | 99.85 | 99.85 | 99.50 | 99.50 | 93.20 | 100 | 93.85 |
| Viscosity Index Improver | OCP | | | | | 3.5 | | 3.5 |
| Component Q | Ashless Dispersant A | | | | | 1.5 | | 1.5 |
| | Ashless Dispersant B | | | | | 1.0 | | 1.0 |
| Component P | Phosphorus-containing Additive A | | | | | 0.15 | | 0.15 |
| Component S | Ethoxylated Oleyl Amine | 0.15 | | | | 0.15 | | |
| | Oleyl Amine | | 0.15 | | | | | |
| Component T | Mg Sulfonate A | | | 0.5 | | | | |
| | Ca Sulfonate A | | | | 0.5 | 0.5 | | |
| Speed Dependency of Friction Coefficient $\mu$(0.12 cm/s)/$\mu$(0.3 cm/s) | | 0.90 (Positive Gradient) | 0.92 (Positive Gradient) | 0.95 (Positive Gradient) | 0.98 (Positive Gradient) | 0.87 (Positive Gradient) | 1.75 (Negative Gradient) | 1.21 (Negative Gradient) |

Four types of fluids (Fluids D-15 and D-27–D-29) were prepared in accordance with the formulations shown in Table 25. Each of Fluids D-15 and D-27 through D-29 was examined in effect of additives exerting on strength of a wet-type clutch against repeated-applied compression. The wet-type clutch was repeatedly compressed under the same conditions as conducted for the above Fluids A-23 through A-26. The results are shown in Table 25.

TABLE 25

| | | Fluid D-27 | Fluid D-28 | Fluid D-29 | Fluid D-15 |
|---|---|---|---|---|---|
| Base Oil | Component D | 97.15 | 93.20 | 97.15 | 97.35 |
| Viscosity Index Improver | OCP | | 3.5 | | |
| Component Q | Ashless Dispersant A | 1.5 | 1.5 | 1.5 | 1.5 |
| | Ashless Dispersant B | 1.0 | 1.0 | 1.0 | 1.0 |
| Component P | Phosphorus-containing Additive A | 0.15 | 0.15 | 0.15 | 0.15 |
| Component T | Ca Sulfonate A | | 0.5 | | |
| | Ca Sulfonate B | 0.2 | | | |
| Component S | Ethoxylated Oleyl Amine | | 0.15 | | |
| Ca Sulfonate C | | | | 0.2 | |
| the No. of cycles taken until the occurrence of peel-off | | 15.2 | 14.5 | 7.2 | 5.8 |

Naphthenic Carbonate (E)

There was synthesized traction drive fluid E-5 in Table 26 which is one typical example of naphthenic carbonates (E) of the invention represented by the formula

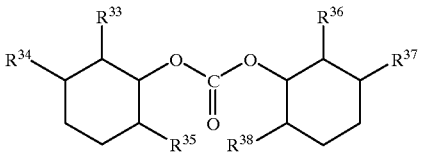

(49)

wherein $R^{33}$ and $R^{36}$ each are methyl group and $R^{34}$, $R^{35}$, $R^{37}$ and $R^{38}$ each are a hydrogen atom, in the following manner.

1713 g of 2-methylcyclohexanol and 5.8 g of metallic sodium were placed into a 2 L round flask and heated at a temperature of 120° C. with nitrogen blow. After the metallic sodium is completely dissolved by reacting the cyclohexanol, 886 g of diethylcarbontae was added in dropwise over about 4 hours, followed by heating at a temperature of 150° C. for 3 hours, thereby completing the reaction. The water produced by the reaction was trapped so as not to return the flask. The resulting product was washed with water until being neutralized and dehydrated, followed by distillation under reduced pressure thereby obtaining di-2-ethylcyclohexylcarbonate which is encompassed by naphthenic carbonate (E) traction drive fluid according to the invention. The final yield was about 80%.

Traction drive fluids E-1 through E-4, E-6 and E-7 each having the structure shown in Table 26 were synthesized in accordance with the above synthesizing method.

TABLE 26

| Sample | Formula (49) $R^{33}$ | $R^{34}$ | $R^{35}$ | $R^{36}$ | $R^{37}$ | $R^{38}$ |
|---|---|---|---|---|---|---|
| Fluid E-1 | H | H | H | H | H | H |
| Fluid E-2 | H | $CH_3$ | H | H | $CH_3$ | H |
| Fluid E-3 | $CH_3$ | H | H | H | H | H |
| Fluid E-4 | $CH_3$ | H | $CH_3$ | H | H | H |
| Fluid E-5 | $CH_3$ | H | H | $CH_3$ | H | H |
| Fluid E-6 | $CH_3$ | H | $CH_3$ | $CH_3$ | H | H |
| Fluid E-7 | $CH_3$ | H | $CH_3$ | $CH_3$ | H | $CH_3$ |

The measurement of traction coefficient was conducted for traction drive fluids E-1, E-2, E-5 and E-7, traction drive fluids E-8 through E-10 which were prepared in accordance with the formulations shown in Table 27 and commercially available traction drive fluid "SANTOTRAC 50" which has been used in the industrial machinery field and known to have a high traction coefficient. The results are shown in Table 27. The traction coefficient of each traction drive fluids E-3, E-4 and E-6 was calculated based on those of other traction drive fluids.

The measurement was conducted in the same manner as conducted for the above examples of naphthenic hydrocarbon (A) above.

TABLE 27

| Sample | Traction Coefficient |
|---|---|
| Fluid E-1 | 0.088 |
| Fluid E-2 | 0.086 |
| Fluid E-5 | 0.092 |
| Fluid E-7 | 0.094 |
| Fluid E-8 (Volume Ratio: Fluid E-1/Fluid E-3/Fluid E-5 = 24/49/27) | 0.090 |
| Fluid E-9 (Volume Ratio: Fluid E-1/Fluid E-4/Fluid E-7 = 23/49/28) | 0.091 |
| Fluid E-10 (Volume Ratio: Fluid E-5/Fluid E-6/Fluid E-7 = 26/47/27) | 0.093 |
| Fluid E-3 (* Note 1) | 0.090 |
| Fluid E-4 (* Note 2) | 0.091 |
| Fluid E-6 (* Note 3) | 0.093 |
| Fluid 9 SANTOTRAC 50 | 0.087 |

Note 1: the value calculated from the traction coefficient of traction drive fluids E-1, E-5 and E-8 assuming that additivity can be applied to traction coefficient;
Note 2: the value calculated from the traction coefficient of traction drive fluids E-1, E-7 and E-9 assuming that additivity can be applied to traction coefficient;
Note 3: the value calculated from the traction coefficient of traction drive fluids E-5, E-7 and E-10 assuming that additivity can be applied to traction coefficient (Component B-3). The traction coefficient and Brookfield viscosity at −30° C. were measured for Fluids E-11 and E-12 and Comparative Fluids 17–20 prepared by using Traction drive fluid E-5, Component F and Component B-3 in accordance with the formulations shown in Table 28. The results are shown in Table 28.

TABLE 28

| | Blend Ratio % | | | | Brookfield |
|---|---|---|---|---|---|
| | Component F | Component E-5 | Component B-3 | Traction Coefficient | Viscosity @ −30° C. mPa · s |
| Fluid 1 | 100 | | | 0.061 | 4500 |
| Fluid E-11 | 50 | 50 | | 0.077 | 10000 |
| Fluid 4 | 50 | | 50 | 0.075 | 12000 |
| Fluid E-12 | 10 | 90 | | 0.089 | 15000 |
| Fluid 3 | 10 | | 90 | 0.086 | 20000 |
| Fluid E-5 | | 100 | | 0.092 | 25000 |
| Fluid 2 | | | 100 | 0.089 | 30000 |

Fluids E-13 through E-15 were prepared by mixing Fluid E-5 with each of polymethacrylate (PMA), polyisobutylene and ethylene-α-olefin copolymer (OCP). Fluids E-13 through E-15 and E-5 were measured of kinematic viscosity at 100° C., low temperature (−30° C.) viscosity and traction coefficient, respectively. The results are shown in Table 29 below. The number-average molecular weight (Mn) and amount of each PMA, PIB and OCP were as follows:

PMA:Mn 18,000, 7.5 mass %, PIB:Mn 2,700, 6.7 mass %

OCP:Mn 9,900, 2.8 mass %

TABLE 29

| | Additive | Kinematic Viscosity @ 100° C. $mm^2/s$ | Brookfield Viscosity at a low temperature @ −30° C. mPa · s | Traction Coefficient |
|---|---|---|---|---|
| Fluid E-5 | None | 2.8 | 25000 | 0.092 |
| Fluid E-13 | PMA | 5.0 | 30000 | 0.087 |
| Fluid E-14 | PIB | 5.0 | 48000 | 0.090 |
| Fluid E-15 | OCP | 5.0 | 31000 | 0.090 |

Six types of fluids (Fluids E-16 through E-21) were prepared by mixing Fluid E-5 with an ashless dispersant and a phosphorus-containing additive in accordance with the formulation shown in Table 30 below. Each of the fluids was evaluated in abrasion resistance and oxidation stability. The results are shown in Table 30.

TABLE 30

| | | | Fluid E-16 | Fluid E-17 | Fluid E-18 | Fluid E-19 | Fluid E-20 | Fluid E-21 |
|---|---|---|---|---|---|---|---|---|
| Base oil | Component E-5 | | 97.35 | 97.35 | 94.05 | 96.70 | 94.20 | 96.55 |
| Viscosity Index Improver | OCP | | | | 2.8 | 2.8 | 2.8 | 2.8 |
| Additives | Component Q | Ashless Dispersant A | 1.5 | | 1.5 | | 1.5 | |
| | | Ashless Dispersant B | 1.0 | 2.5 | 1.0 | | 1.0 | |
| | Component P | Phosphorus containing Additive A | 0.15 | 0.15 | 0.15 | | | 0.15 |
| | Oxidation Inhibitor (bisphenol) | | | | 0.5 | 0.5 | 0.5 | 0.5 |
| Vane Pump Test (ASTM D2882; 80° C., 6.9 Mpa) | | | | | 11.9 | | 792.6 | |
| Abrasion Wear, mg | | | | | | | | |
| ISOT (JIS K2514; 150° C., 96 h) | | | 0.37 | 0.42 | 0.35 | 0.59 | 0.30 | 0.91 |
| Total Acid Value Increase, mg KOH/g | | | | | | | | |
| Lacquer Rating (deposit) | | | none | none | none | medium | none | dark |
| n-petane insoluble, mass % | | | 0.00 | 0.00 | 0.00 | 0.18 | 0.00 | 0.39 |

Fluids E-22 through E-26 were prepared in accordance with the formulations indicated in Table 31. The dependence of friction coefficient on slipping speed of each fluid was measured in accordance with the same manner and conditions as the foregoing. The results are shown in Table 31 below.

TABLE 31

| | | Fluid E-22 | Fluid E-23 | Fluid E-24 | Fluid E-25 | Fluid E-26 | Fluid E-5 | Fluid E-27 |
|---|---|---|---|---|---|---|---|---|
| Base oil | Component E-5 | 99.85 | 99.85 | 99.50 | 99.50 | 93.50 | 100 | 94.15 |
| Viscosity Index Improver | OCP | | | | | 2.8 | | 2.8 |
| Component Q | Ashless Dispersant A | | | | | 1.5 | | 1.5 |
| | Ashless Dispersant B | | | | | 1.0 | | 1.0 |
| Component P | Phosphorus-containing Additive A | | | | | 0.15 | | 0.15 |
| Component S | Ethoxylated Oleyl Amine | 0.15 | | | | 0.15 | | |
| | Oleyl Amine | | 0.15 | | | | | |
| Component | Mg | | | 0.5 | | | | |

TABLE 31-continued

| | | Fluid E-22 | Fluid E-23 | Fluid E-24 | Fluid E-25 | Fluid E-26 | Fluid E-5 | Fluid E-27 |
|---|---|---|---|---|---|---|---|---|
| T | Sulfonate A | | | | | | | |
| | Ca Sulfonate A | | | | 0.5 | 0.5 | | |
| Speed Dependency of Friction Coefficient $\mu$(0.12 cm/s)/$\mu$(0.3 cm/s) | | 0.86 (Positive Gradient) | 0.89 (Positive Gradient) | 0.93 (Positive Gradient) | 0.96 (Positive Gradient) | 0.83 (Positive Gradient) | 1.42 (Negative Gradient) | 1.10 (Negative Gradient) |

Four types of fluids (Fluids E-16 and E-28–E-30) were prepared in accordance with the formulations shown in Table 32. Each of Fluids E-19 through E-22 was examined in effect of additives exerting on strength of a wet-type clutch against repeated-applied compression. The wet-type clutch was repeatedly compressed under the same conditions as conducted for the above Fluids A-23 through A-26. The results are shown in Table 32.

TABLE 32

| | | Fluid E-28 | Fluid E-29 | Fluid E-30 | Fluid E-16 |
|---|---|---|---|---|---|
| Base Oil | Component E-5 | 797.15 | 93.90 | 97.15 | 97.35 |
| Viscosity Index Improver | OCP | | 2.8 | | |
| Component Q | Ashless Dispersant A | 1.5 | 1.5 | 1.5 | 1.5 |
| | Ashless Dispersant B | 1.0 | 1.0 | 1.0 | 1.0 |
| Component P | Phosphorus containing Additive A | 0.15 | 0.15 | 0.15 | 0.15 |
| Component T | Ca Sulfonate A | | 0.5 | | |
| | Ca Sulfonate B | 0.2 | | | |
| Component S | Ethoxy Oleyl Amine | | 0.15 | | |
| Ca Sulfonate C | | | | 0.2 | |
| the No. of cycles taken until the occurrence of peel-off | | 16.2 | 15.3 | 7.1 | 5.3 |

What is claimed is:

1. A traction drive fluid which comprises a tractant selected from the group consisting of naphthenic hydrocarbons (A) and (B), naphthenic carboxylates (C) and (D) and a naphthenic carbonate (E), said naphthenic hydrocarbon (A) being represented by the formula (1)

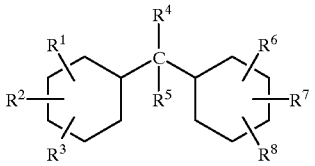

wherein among $R^1$ through $R^8$, $R^4$ is a $C_1$–$C_8$ alkyl group which may have a naphthene ring and the remainders each are a hydrogen atom or a $C_1$–$C_8$ alkyl group which may have a naphthene ring;

said naphthenic hydrocarbon (B) being represented by the formula (7)

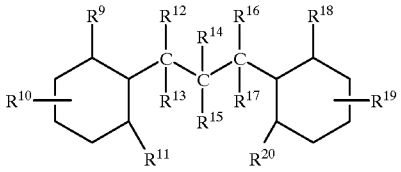

wherein $R^9$ through $R^{20}$ each are a hydrogen atom or a $C_1$–$C_8$ alkyl group which may have a naphthene ring, at least more than two members selected arbitrarily from $R^{12}$, $R^{13}$ and $R^{16}$ each are a $C_1$–$C_8$ alkyl group which may have a naphthene ring, at least one member selected arbitrarily from $R^9$, $R^{11}$, $R^{18}$ and $R^{20}$ is a $C_1$–$C_8$ alkyl group which may have a naphthene ring;

said naphthenic carboxylate (C) being represented by the formula (3)

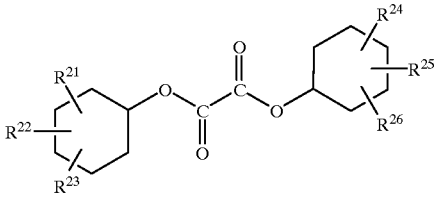

wherein $R^{21}$, $R^{22}$, $R^{23}$, $R^{24}$, $R^{25}$ and $R^{26}$ each are a hydrogen atom or a $C_1$–$C_8$ alkyl group which may have a naphthene ring;

said naphthenic carboxylate (D) being represented by the formula (4)

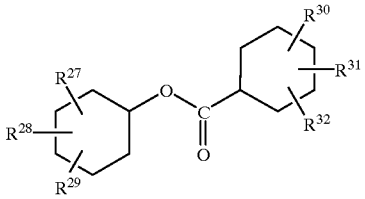

wherein $R^{27}$, $R^{28}$, $R^{29}$, $R^{30}$, $R^{31}$ and $R^{32}$ each are a hydrogen atom or a $C_1$–$C_8$ alkyl group which may have a naphthene ring; and said naphthenic carbonate (E) being represented by the formula (5)

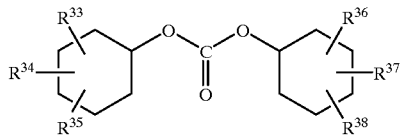

wherein $R^{33}$, $R^{34}$, $R^{35}$, $R^{36}$, $R^{37}$ and $R^{38}$ each are a hydrogen atom or a $C_1$–$C_8$ alkyl group which may have a naphthene ring.

2. A traction drive fluid according to claim 1 wherein said naphthenic hydrocarbon (A) is represented by the formula (6)

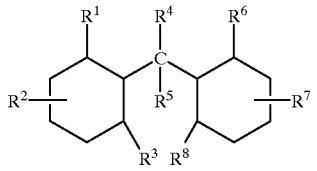

wherein $R^4$ is a $C_1$–$C_8$ alkyl group which may have a naphthene ring, $R^1$ through $R^3$ and $R^6$ through $R^8$ each are a hydrogen atom or a $C_1$–$C_8$ alkyl group which may have a naphthene ring and at least one member selected arbitrarily from $R^1$, $R^3$, $R^6$ and $R^8$ is a $C_1$–$C_8$ alkyl group which may have a naphthene ring;

said naphthenic carboxylate (C) is represented by the formula (8)

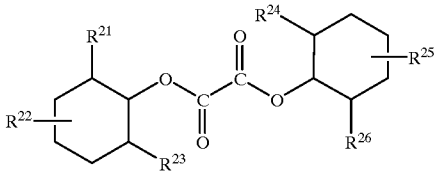

wherein $R^{21}$ through $R^{26}$ each are a hydrogen atom or a $C_1$–$C_8$ alkyl group which may have a naphthene ring and at least one member selected arbitrarily from $R^{21}$, $R^{23}$, $R^{24}$ and $R^{26}$ is a $C_1$–$C_8$ alkyl group which may have a naphthene ring;

said naphthenic carboxylate (D) is represented by the formula (9)

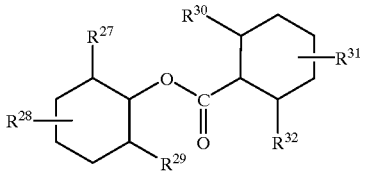

wherein $R^{27}$ through $R^{32}$ each are a hydrogen atom or a $C_1$–$C_8$ alkyl group which may have a naphthene ring and at least one member selected from $R^{27}$, $R^{29}$, $R^{30}$ and $R^{32}$ is a $C_1$–$C_8$ alkyl group which may have a naphthene ring; and said naphthenic carbonate (E) is represented by the formula (10)

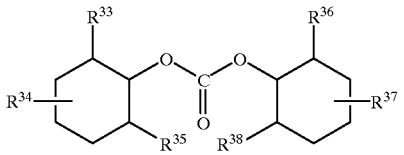

wherein $R^{33}$ through $R^{38}$ each are a hydrogen atom or a $C_1$–$C_8$ alkyl group which may have a naphthene ring and at least one member selected from the group consisting of $R^{33}$, $R^{35}$, $R^{36}$ and $R^{38}$ is a $C_1$–$C_8$ alkyl group which may have a naphthene ring.

3. A traction drive fluid according to claim 1 wherein said naphthenic hydrocarbon (A) is represented by the formula (11)

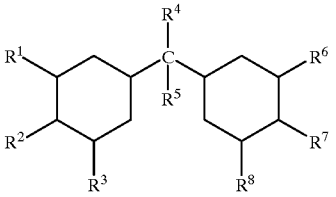

wherein $R^4$ is a $C_1$–$C_8$ alkyl group which may have a naphthene ring, $R^1$ through $R^3$ and $R^6$ through $R^8$ each are a hydrogen atom or a $C_1$–$C_8$ alkyl group which may have a naphthene ring and at least one member selected arbitrary from $R^1$ through $R^3$ and $R^6$ through $R^8$ is a $C_1$–$C_8$ alkyl group which may have a naphthene ring.

4. A traction drive fluid according to claim 1 wherein said tractant is said naphthenic hydrocarbon (A) and which fluid further comprises a base oil of a synthetic oil selected from the group consisting of those represented by the formulae (27)

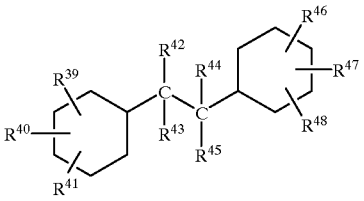

wherein $R^{39}$ through $R^{48}$ each are a hydrogen atom or a $C_1$–$C_8$ alkyl group which may have a naphthene ring;

(28)

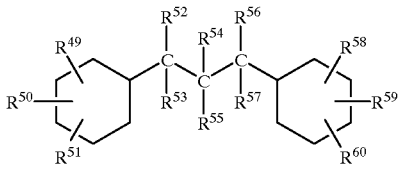

wherein $R^{49}$ through $R^{60}$ each are a hydrogen atom or a $C_1$–$C_8$ alkyl group which may have a naphthene ring;

(29)

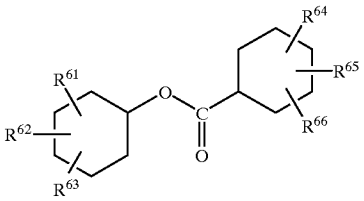

wherein $R^{61}$ through $R^{66}$ each are a hydrogen atom or a $C_1$–$C_8$ alkyl group which may have a naphthene ring;

(30)

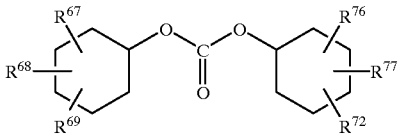

wherein $R^{67}$ through $R^{72}$ each are a hydrogen atom or a $C_1$–$C_8$ alkyl group which may have a naphthene ring; and (31)

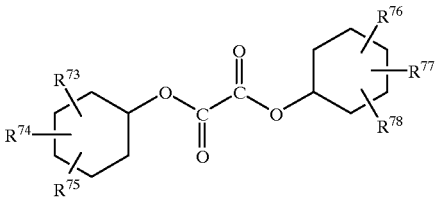

wherein $R^{73}$ through $R^{78}$ each are a hydrogen atom or a $C_1$–$C_8$ alkyl group which may have a naphthene ring.

5. A traction drive fluid according to claim 1 wherein said tractant is said naphthenic carboxylate (C) and which fluid further comprises a base oil of a synthetic oil selected from the group consisting of those represented by the formulae (27)

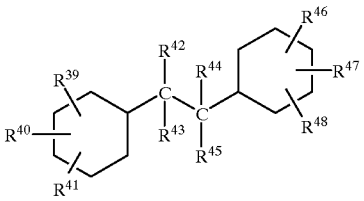

wherein $R^{39}$ through $R^{48}$ each are a hydrogen atom or a $C_1$–$C_8$ alkyl group which may have a naphthene ring;

(28)

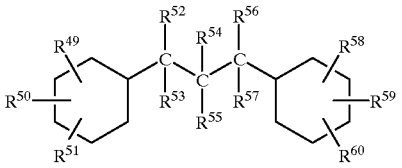

wherein $R^{49}$ through $R^{60}$ each are a hydrogen atom or a $C_1$–$C_8$ alkyl group which may have a naphthene ring;

(29)

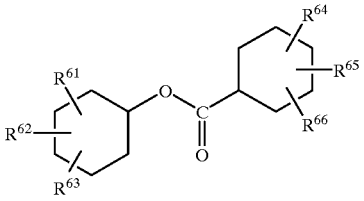

wherein $R^{61}$ through $R^{72}$ each are a hydrogen atom or a $C_1$–$C_8$ alkyl group which may have a naphthene ring;

(30)

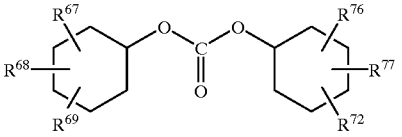

wherein $R^{67}$ through $R^{72}$ each are a hydrogen atom or a $C_1$–$C_8$ alkyl group which may have a naphthene ring; and (32)

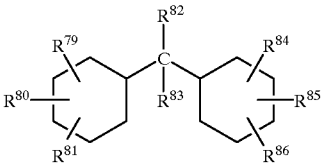

where $R^{79}$ through $R^{86}$ each are a hydrogen atom or a $C_1$–$C_8$ alkyl group which may have a naphthene ring.

6. A traction drive fluid according to claim 3 wherein said tractant is said naphthenic carboxylate (D) and which further comprises a base oil of a synthetic oil selected from the group consisting of those represented by the formulae (27)

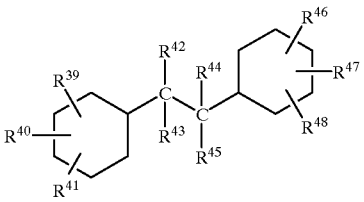

wherein $R^{39}$ through $R^{48}$ each are a hydrogen atom or a $C_1$–$C_8$ alkyl group which may have a naphthene ring;

(28)

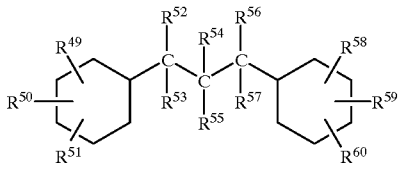

wherein $R^{49}$ through $R^{60}$ each are a hydrogen atom or a $C_1$–$C_8$ alkyl group which may have a naphthene ring;

(30)

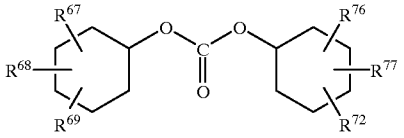

wherein $R^{67}$ through $R^{72}$ each are a hydrogen atom or a $C_1$–$C_8$ alkyl group which may have a naphthene ring;

(31)

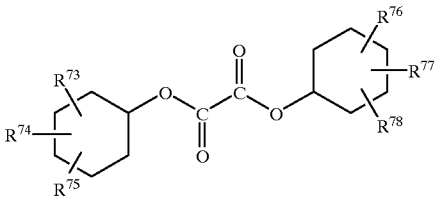

wherein $R^{73}$ through $R^{78}$ each are a hydrogen atom or a $C_1$–$C_8$ alkyl group which may have a naphthene ring;

(32)

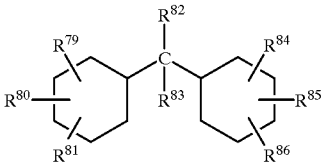

wherein $R^{79}$ through $R^{86}$ each are a hydrogen atom or a $C_1$–$C_8$ alkyl group which may have a naphthene ring.

7. A traction drive fluid according to claim 1 wherein said tractant is said naphthenic carboxylate (E) and which fluid further comprises a base oil of a synthetic oil selected from the group consisting of those represented by the formulae (27)

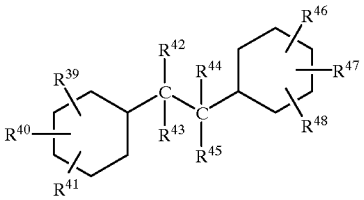

wherein $R^{39}$ through $R^{48}$ each are a hydrogen atom or a $C_1$–$C_8$ alkyl group which may have a naphthene ring;

(28)

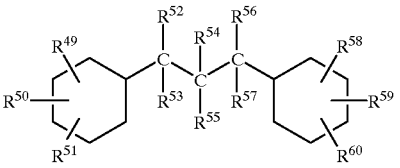

wherein $R^{49}$ through $R^{60}$ each are a hydrogen atom or a $C_1$–$C_8$ alkyl group which may have a naphthene ring;

(29)

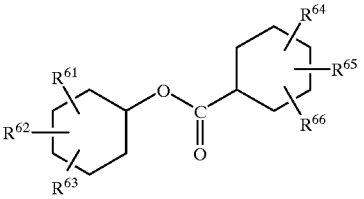

wherein $R^{61}$ through $R^{66}$ each are a hydrogen atom or a $C_1$–$C_8$ alkyl group which may have a naphthene ring;

(31)

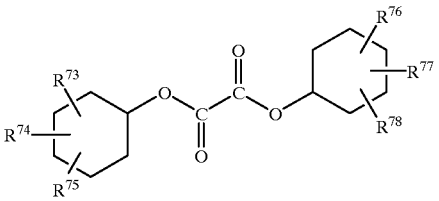

wherein $R^{73}$ through $R^{78}$ each are a hydrogen atom or a $C_1$–$C_8$ alkyl group which may have a naphthene ring; and (32)

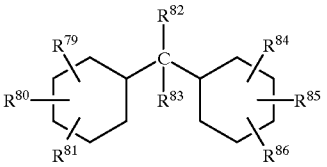

wherein $R^{79}$ through $R^{86}$ each are a hydrogen atom or a $C_1$–$C_8$ alkyl group which may have a naphthene ring.

8. A traction drive fluid according to claim 1 which further comprises a base oil selected from the group consisting of a mineral oil and a synthetic oil having a molecular weight of 150–800 and an effective amount of an additive selected from the group consisting of a viscosity index improver, an ashless dispersant, a phosphorus-containing additive, a friction adjusting agent, an additive for enhancing coefficient of friction, a metal-containing detergent, an oxidation inhibitor and an extreme pressure additive.

9. A traction drive fluid which comprises a tractant wherein said tractant is a naphthenic hydrocarbon (B) represented by the formula (2)

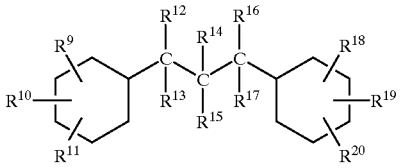

and which fluid further comprises a base oil of synthetic oil selected from the group consisting of those represented by the formulae (27)

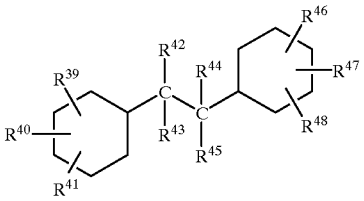

wherein $R^{39}$ through $R^{48}$ each are a hydrogen atom or a $C_1$–$C_8$ alkyl group which may have a naphthene ring;

(29)

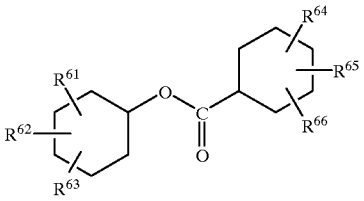

wherein $R^{61}$ through $R^{66}$ each are a hydrogen atom or a $C_1$–$C_8$ alkyl group which may have a naphthene ring;

(30)

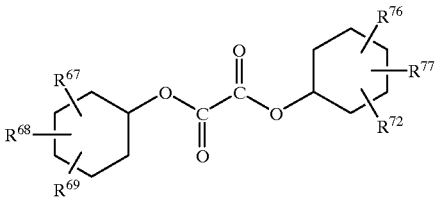

wherein $R^{67}$ through $R^{72}$ each are a hydrogen atom or a $C_1$–$C_8$ alkyl group which may have a naphthene ring;

(31)

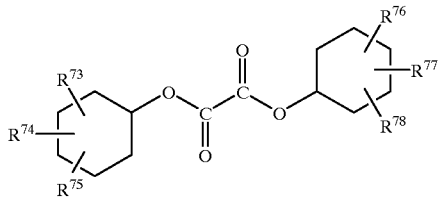

wherein $R^{73}$ through $R^{78}$ each are a hydrogen atom or a $C_1$–$C_8$ alkyl group which may have a naphthene ring; and (32)

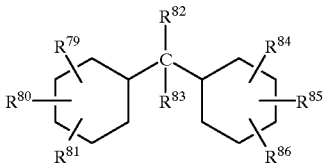

wherein $R^{79}$ through $R^{86}$ each are a hydrogen atom or a $C_1$–C alkyl group which may have a naphthene ring.

10. A traction drive fluid which comprises a tractant wherein said tractant is a naphthenic hydrocarbon represented by the formula (2)

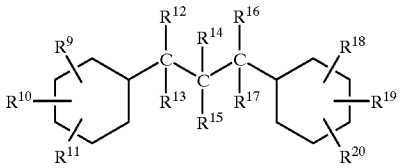

and which fluid further comprises a base oil selected from the group consisting of a mineral oil and a synthetic oil having a molecular weight within a range of about 150 to 800 and an additive selected from the group consisting of a viscosity index improver, an ashless dispersant, a phosphorus-containing additive, a friction adjusting agent, an additive for enhancing the coefficient of friction, a metal containing detergent, an oxidation inhibitor, and an extreme pressure additive.

* * * * *